US010676831B2

(12) United States Patent
Takeuchi

(10) Patent No.: US 10,676,831 B2
(45) Date of Patent: Jun. 9, 2020

(54) ELECTROLYSIS CATHODE AND METHOD FOR PRODUCING ELECTROLYSIS CATHODE

(71) Applicant: DE NORA PERMELEC LTD, Fujisawa-shi, Kanagawa (JP)

(72) Inventor: Atsumi Takeuchi, Fujisawa (JP)

(73) Assignee: DE NORA PERMELEC LTD, Fujisawa-shi, Kanagawa (JP)

( * ) Notice: Subject to any disclaimer, the term of this patent is extended or adjusted under 35 U.S.C. 154(b) by 105 days.

(21) Appl. No.: 15/316,733

(22) PCT Filed: Jul. 14, 2015

(86) PCT No.: PCT/JP2015/070185
§ 371 (c)(1),
(2) Date: Dec. 6, 2016

(87) PCT Pub. No.: WO2016/010045
PCT Pub. Date: Jan. 21, 2016

(65) Prior Publication Data

US 2017/0198402 A1 Jul. 13, 2017

(30) Foreign Application Priority Data

Jul. 15, 2014 (JP) ..... 2014-145423

(51) Int. Cl.
*C25B 11/04* (2006.01)
*C25B 11/03* (2006.01)

(52) U.S. Cl.
CPC ..... *C25B 11/0405* (2013.01); *C25B 11/03* (2013.01); *C25B 11/0415* (2013.01); *C25B 11/0484* (2013.01)

(58) Field of Classification Search
CPC ..... C25B 11/00; C25B 11/02; C25B 11/03–11/035; C25B 11/04;
(Continued)

(56) References Cited

U.S. PATENT DOCUMENTS 4,300,992 A * 11/1981 Yoshida ..... C25B 11/0484 204/242
5,164,062 A * 11/1992 Byrd ..... C25B 11/0478 204/284
(Continued)

FOREIGN PATENT DOCUMENTS

CN 1509345 6/2004
CN 104937142 9/2015
(Continued)

OTHER PUBLICATIONS

International Search Report issued in the corresponding International PCT application No. PCT/JP2015/070185, dated Sep. 8, 2015, 3 pages.
(Continued)

*Primary Examiner* — Alexander W Keeling
(74) *Attorney, Agent, or Firm* — Hamre, Schumann, Mueller & Larson, P.C.

(57) ABSTRACT

The claimed invention provides an economical cathode for electrolysis and a method of manufacturing the same. The cathode includes a conductive base and a catalyst layer including a catalyst component. The conductive base, e.g. a wire mesh, includes plural intersection portions and is made of nickel. The cathode catalyst layer includes a catalyst component, such as platinum, and is formed by applying an application liquid to the base and drying and solidifying the liquid. The solidified portion of the applied liquid is not formed in the intersection portions of the base, or even if formed, the cross-sectional shape of the solidified portion has mesh-shaped pores with an average porosity of 15% or larger. The base is prepared by preheating to a temperature from 43° C. to 120° C. immediately before applying the application liquid, and thereafter the cathode catalyst layer is formed.

10 Claims, 14 Drawing Sheets

(58) Field of Classification Search
CPC ..... C25B 11/0405; C25B 11/041; C25B 11/0415; C25B 11/0431; C25B 11/0442; C25B 11/0447; C25B 11/0452; C25B 11/0473; C25B 11/0478; C25B 11/0484; C25B 11/0494
USPC ..... 427/319, 58–126.6
See application file for complete search history.

(56) References Cited

U.S. PATENT DOCUMENTS

| | | | | |
|---|---|---|---|---|
| 6,312,571 | B1 * | 11/2001 | Nara | C25B 11/0484 204/252 |
| 2004/0151896 | A1 | 8/2004 | Houda et al. | |
| 2006/0231387 | A1 | 10/2006 | Houda et al. | |
| 2015/0259811 | A1 | 9/2015 | Takeuchi | |

FOREIGN PATENT DOCUMENTS

| | | |
|---|---|---|
| JP | 51131474 | 11/1976 |
| JP | 5522556 | 6/1980 |
| JP | 3253590 | 11/1991 |
| JP | 4453973 | 4/2010 |
| JP | 5548296 | 7/2014 |
| JP | 2015052145 | 3/2015 |
| KR | 10-2004-0002977 | 1/2004 |
| WO | 2015/033989 | 3/2015 |

OTHER PUBLICATIONS

Extended European Search Report, issued in the corresponding European patent application No. 15822165.5, dated Apr. 16, 2018, 8 pages.
Korean Office Action, issued in the corresponding Korean patent application No. 10-2017-7000542, dated Dec. 7, 2017, 9 pages (machine translation enclosed), where the Office Action was filed in the IDS of Dec. 11, 2017.
Chinese Office Action, issued in the corresponding Chinese patent application No. 201580038450.2, dated Dec. 27, 2017, 14 pages (machine translation enclosed), where the Office Action was filed in the IDS of Feb. 5, 2018.
Taiwanese Office Action, issued in the corresponding Taiwanese patent application No. 104122921, dated Aug. 23, 2018, 11 pages (machine translation enclosed), where the Office Action was filed in the IDS of Sep. 20, 2018.
Taiwan Office Action, issued in the corresponding Taiwan patent application No. 104122921, dated Aug. 23, 2018, 7 pages.
Second Chinese Office Action, issued in the corresponding Chinese patent application No. 201580038450.2, dated Aug. 30, 2018, 10 pages (machine translation enclosed).

* cited by examiner

[FIG. 1]
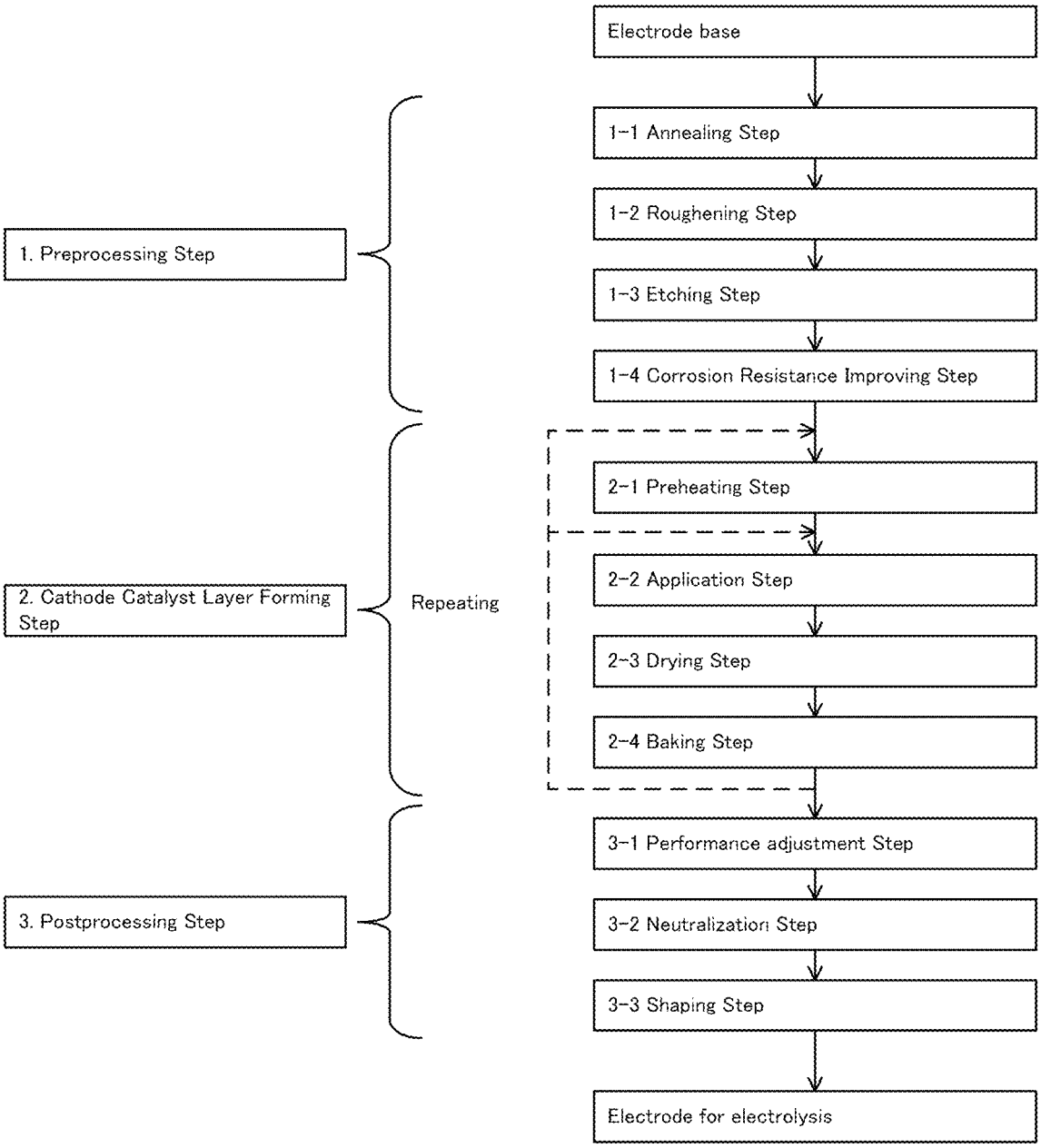

[FIG. 2-1]
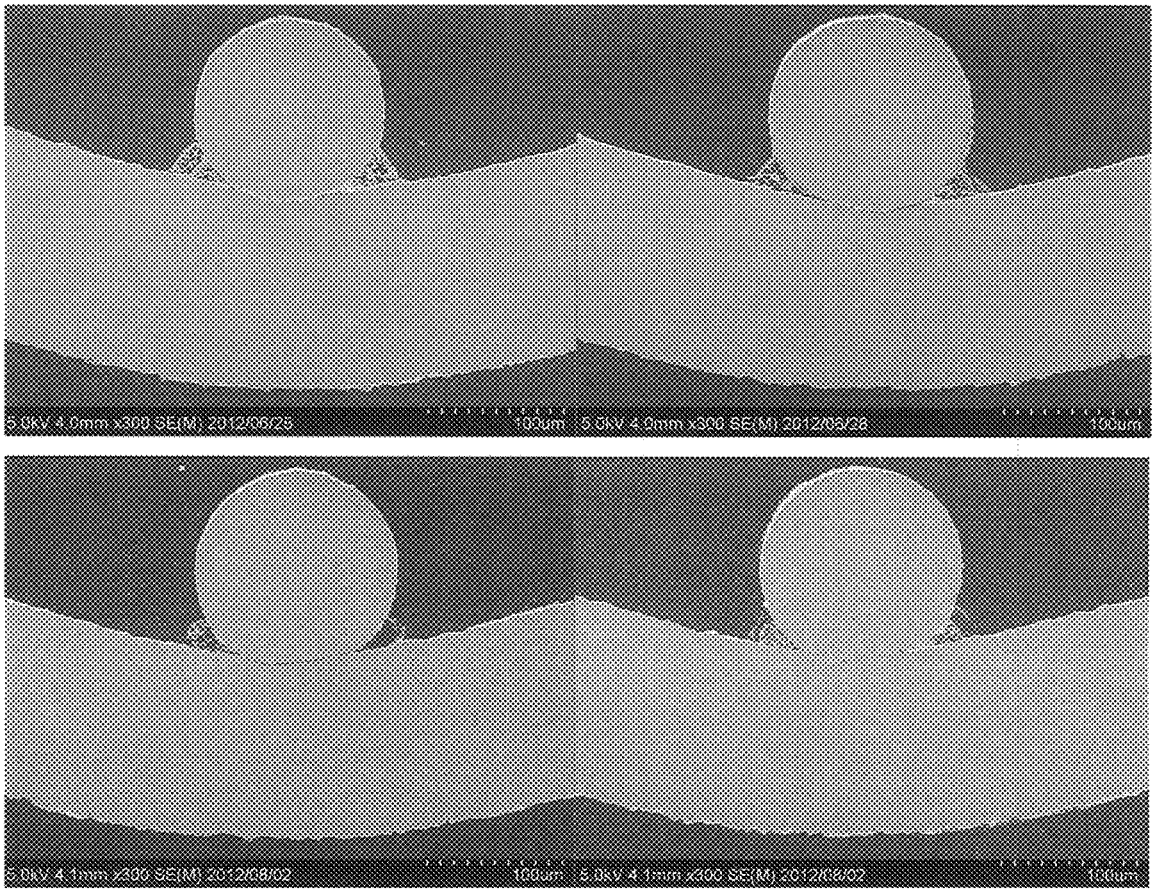

[FIG. 2-2]
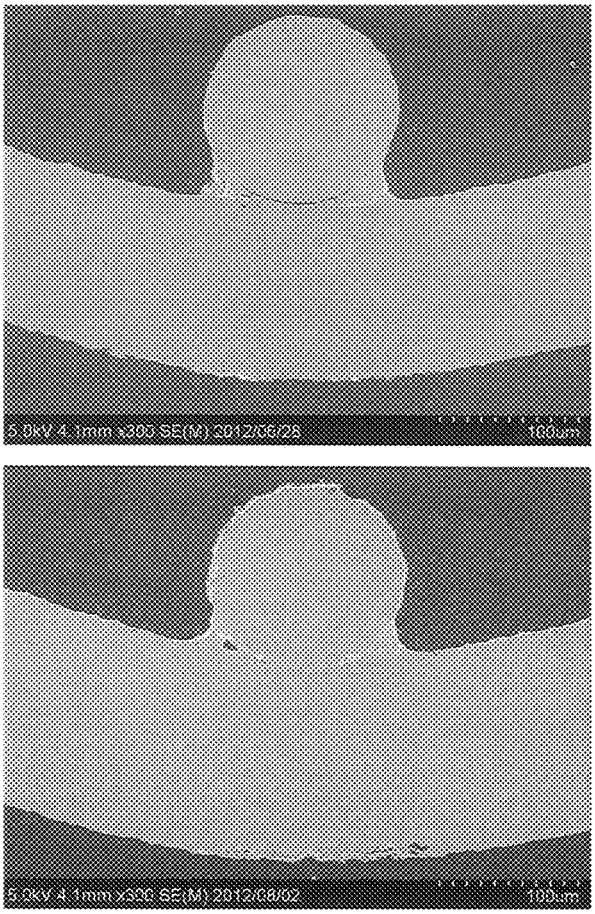

[FIG. 3]
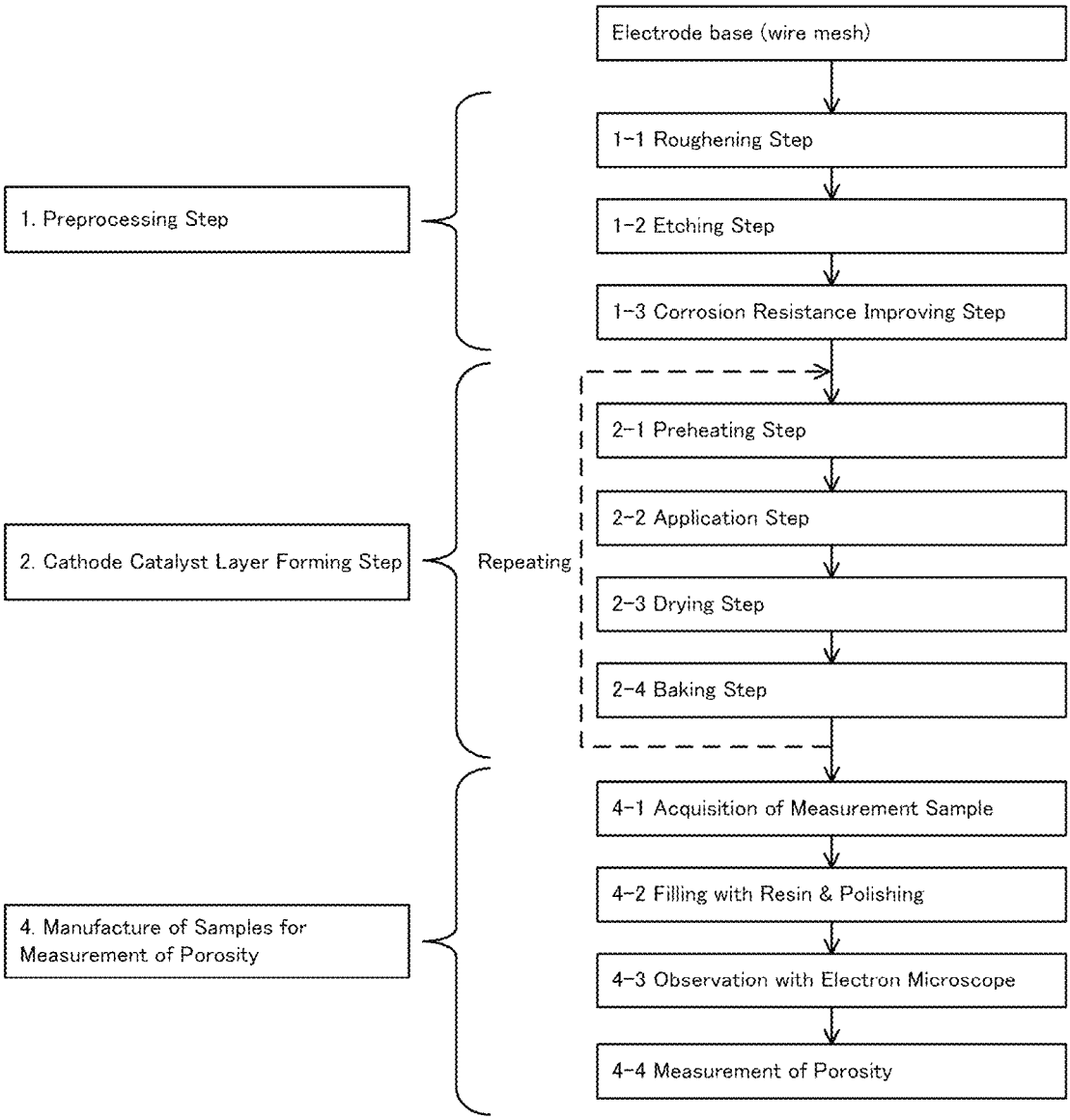

[FIG. 4-1]
(1) Example 3-1
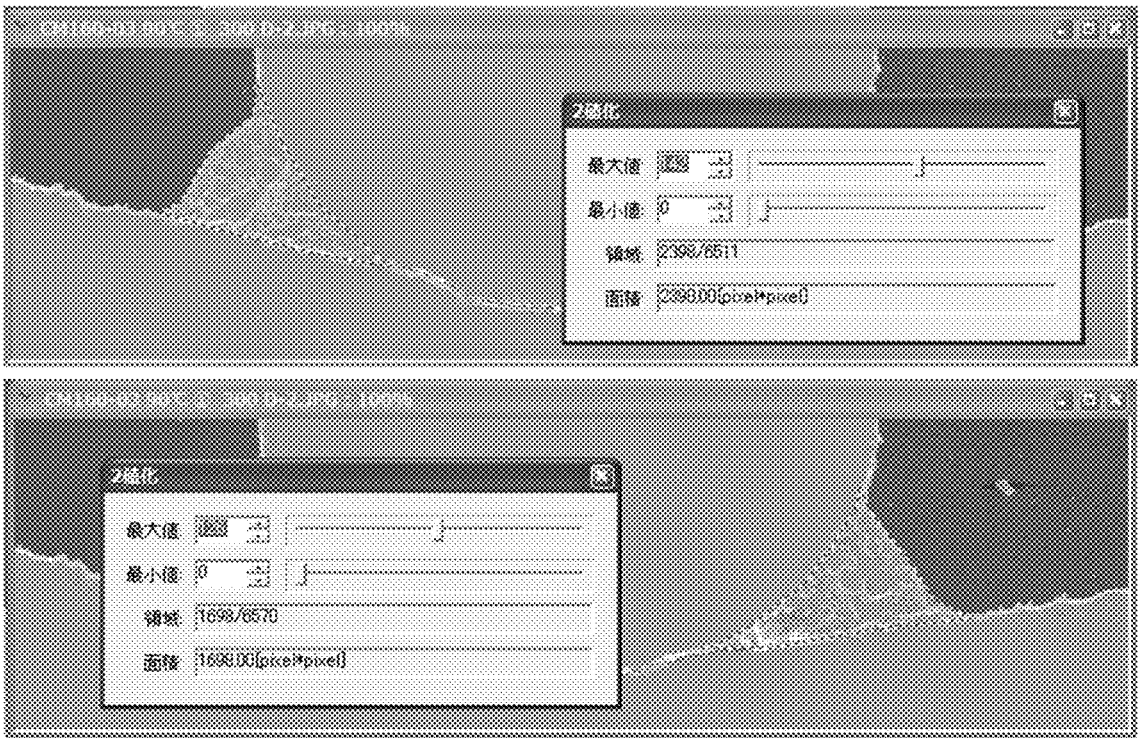
(2) Example 3-2
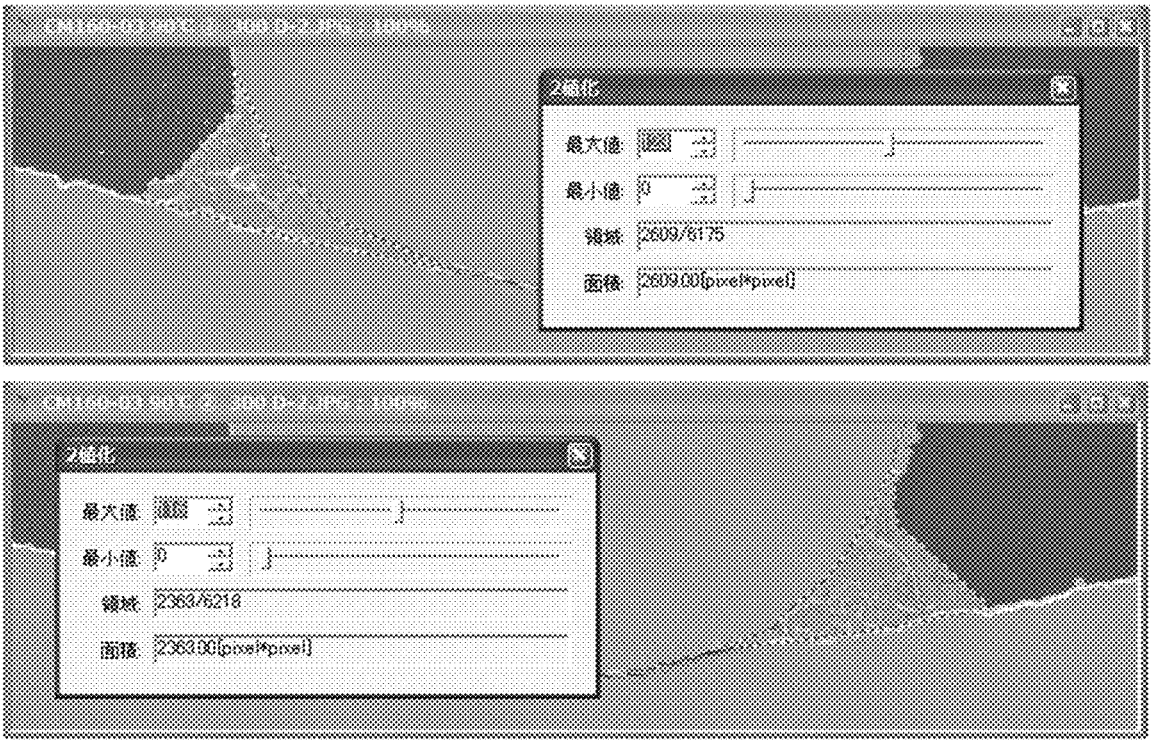

[FIG. 4-2]
(3) Example 3-3
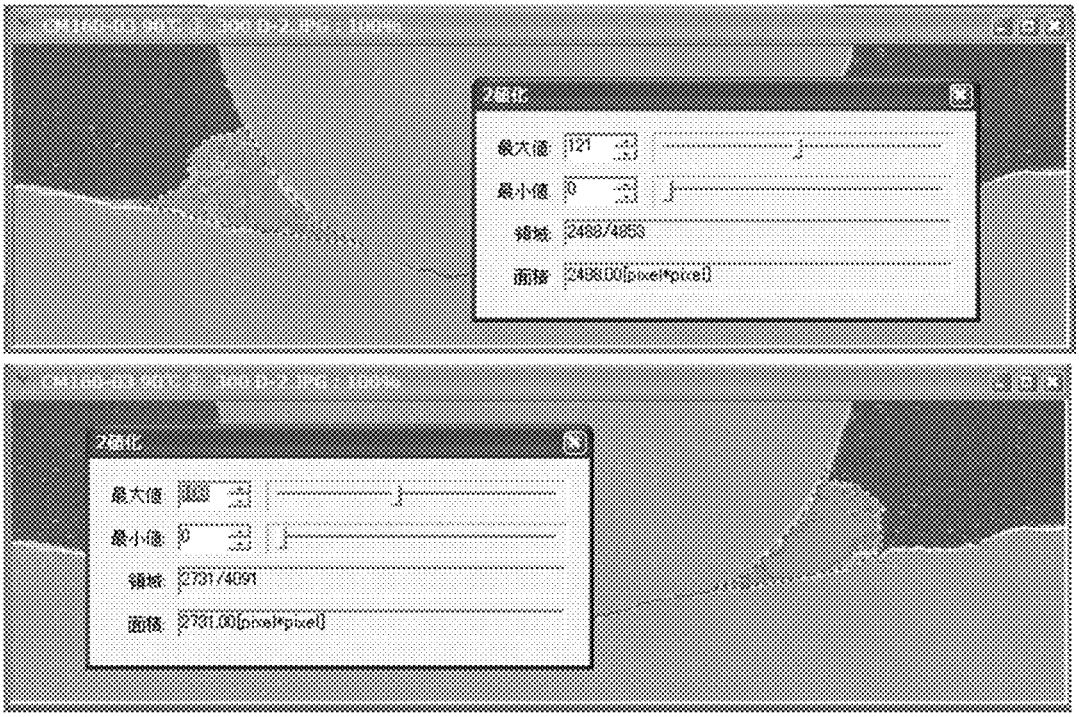
(4) Example 3-4
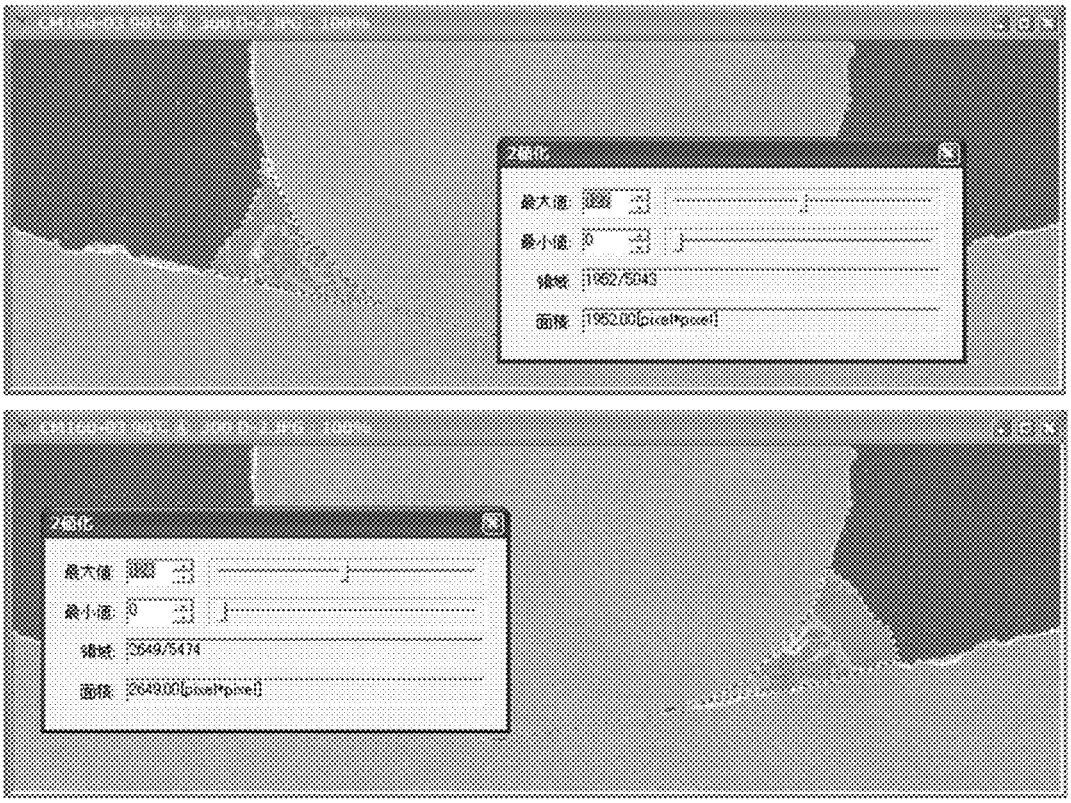

[FIG. 5]
(1) Example 4-2
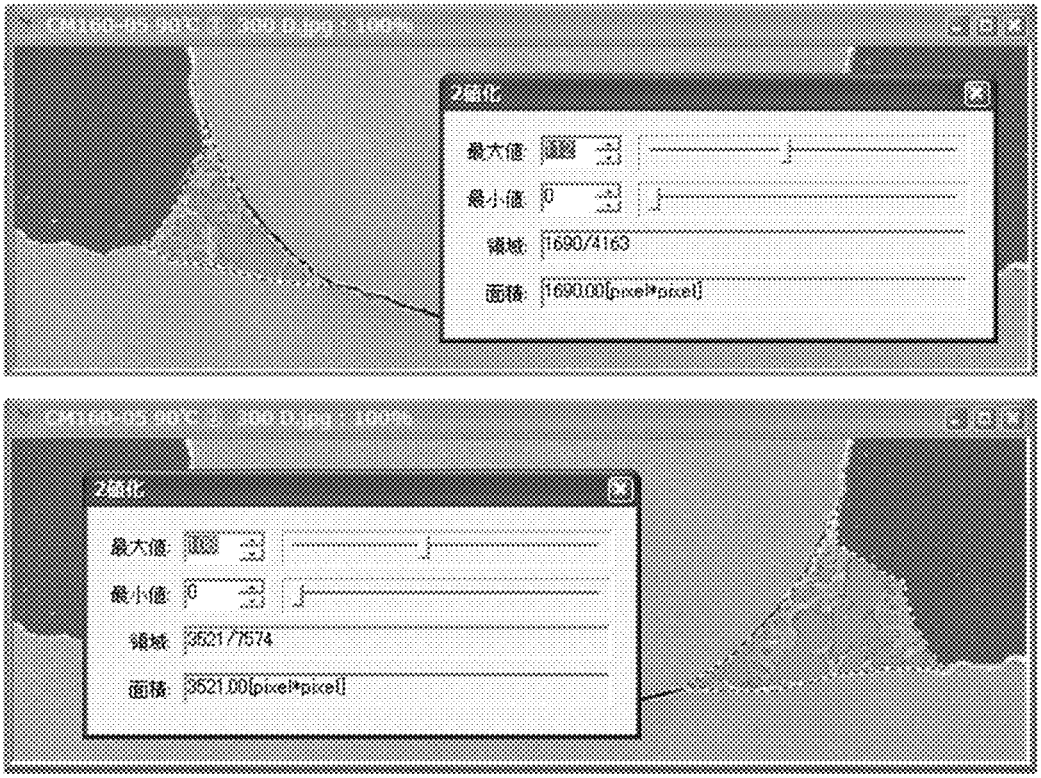
(2) Example 4-4
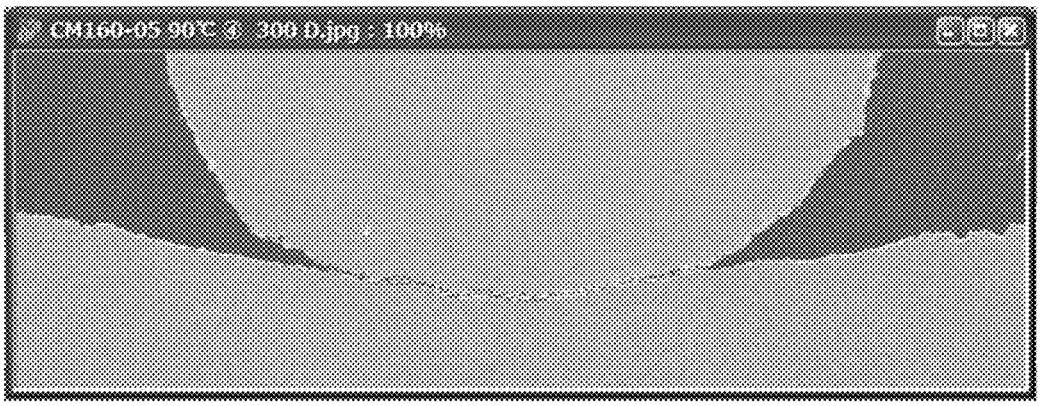

[FIG. 6-1]
(1) Comparative Example 1-1
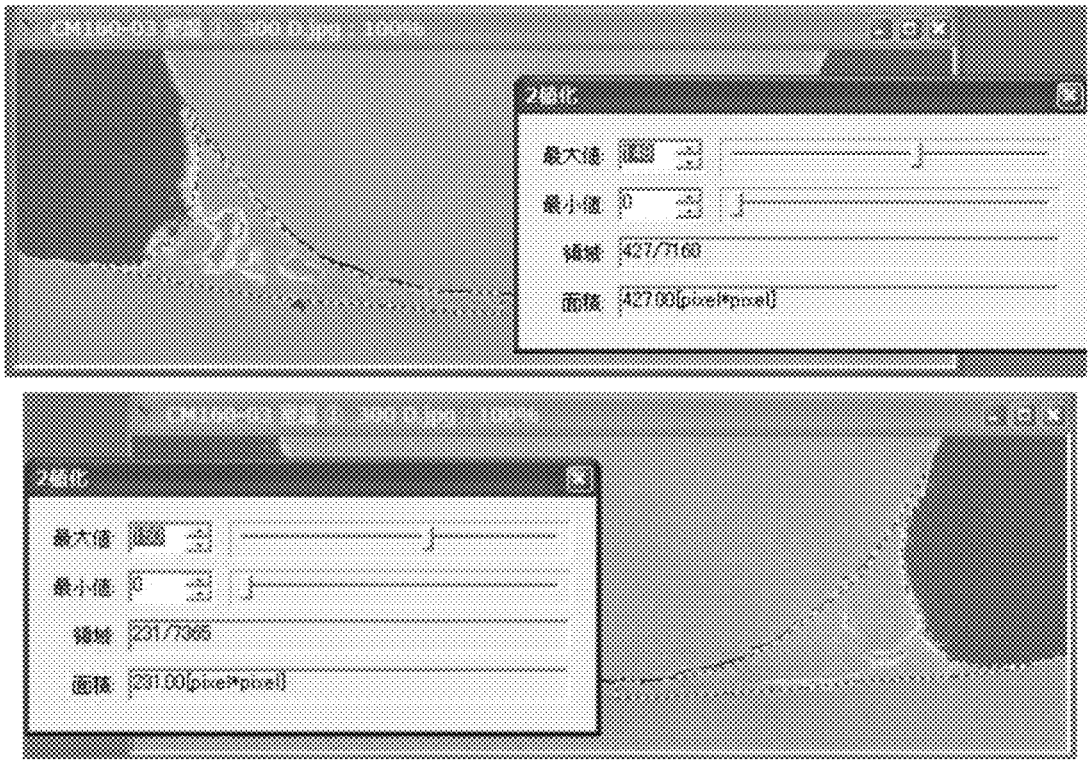
(2) Comparative Example 1-2
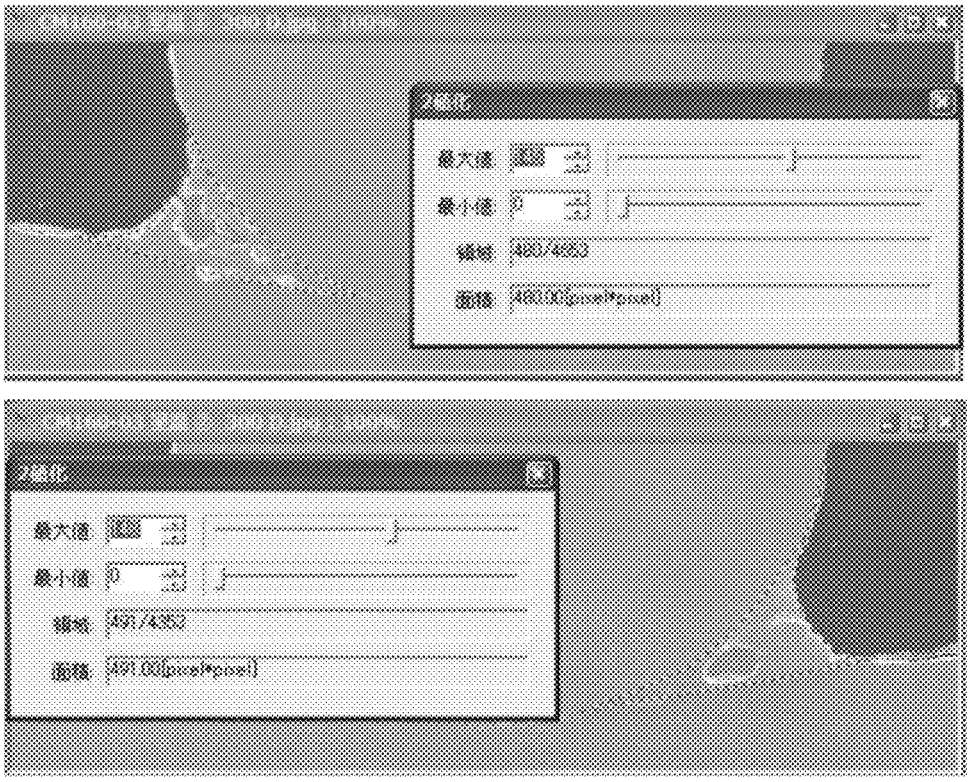

[FIG. 6-2]
(3) Comparative Example 1-3
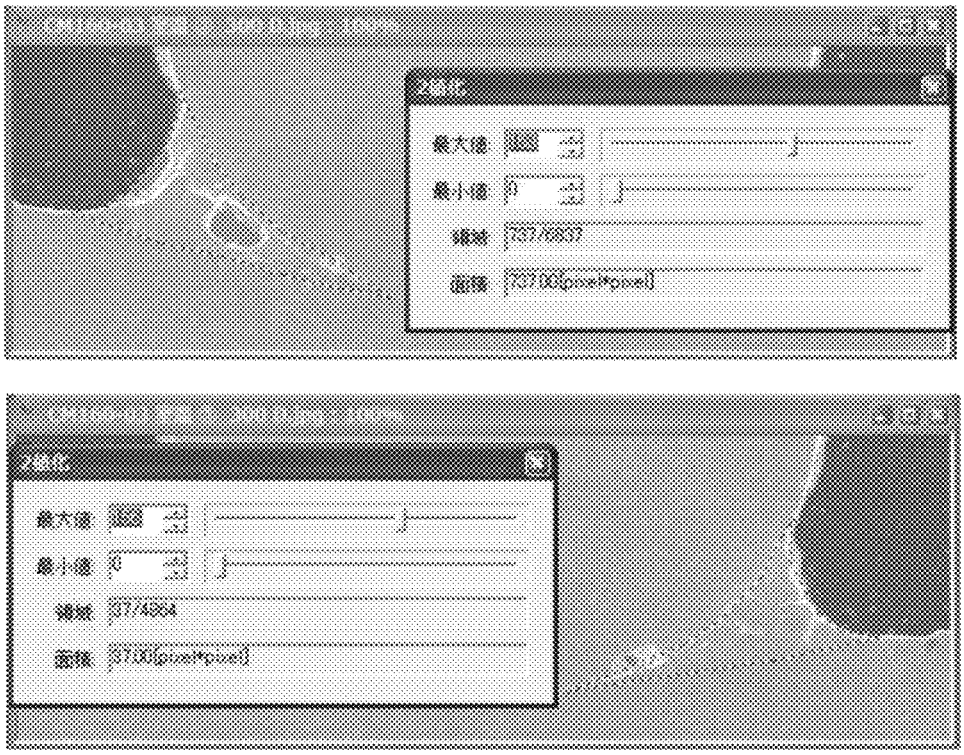
(4) Comparative Example 1-4
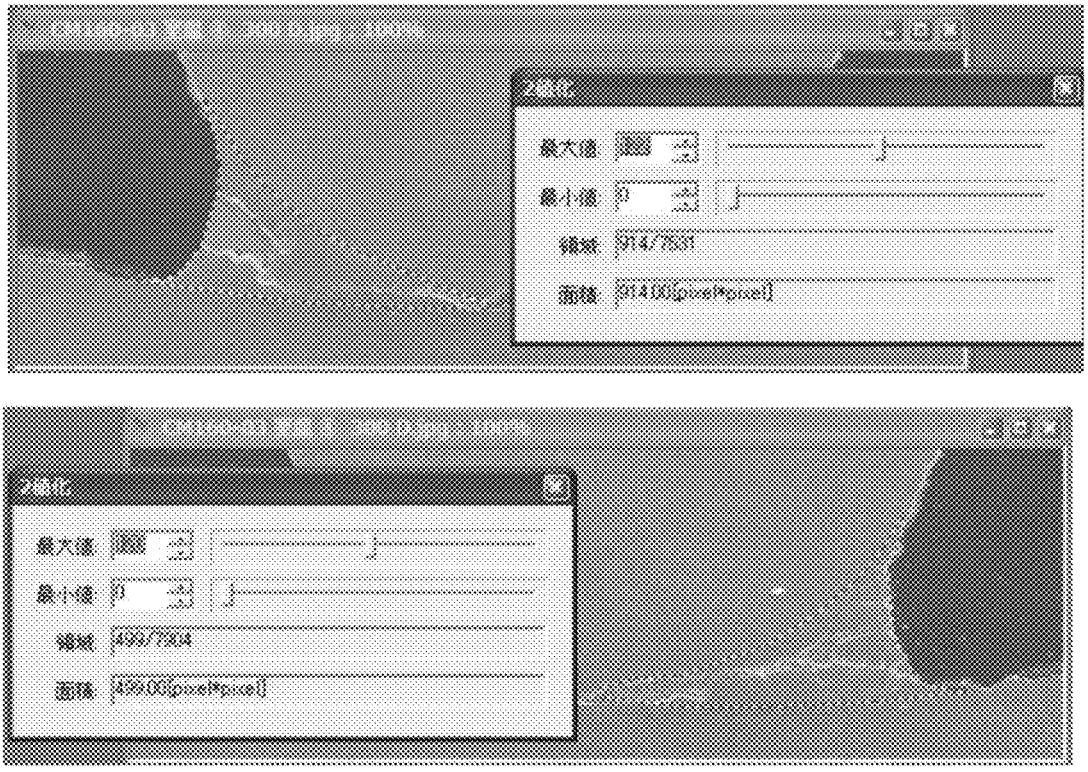

[FIG. 7]
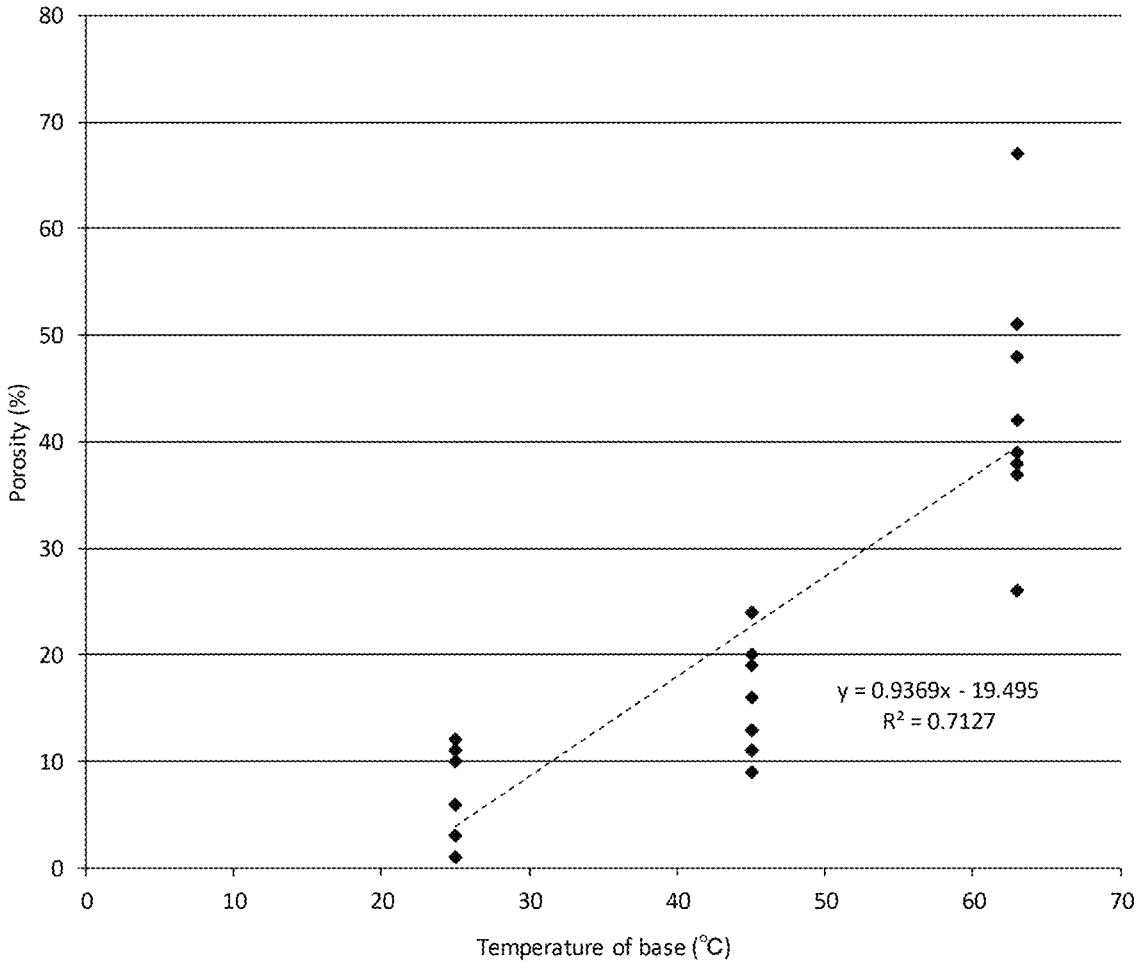
Application liquid with concentration of 100 g/ℓ

[FIG. 8]
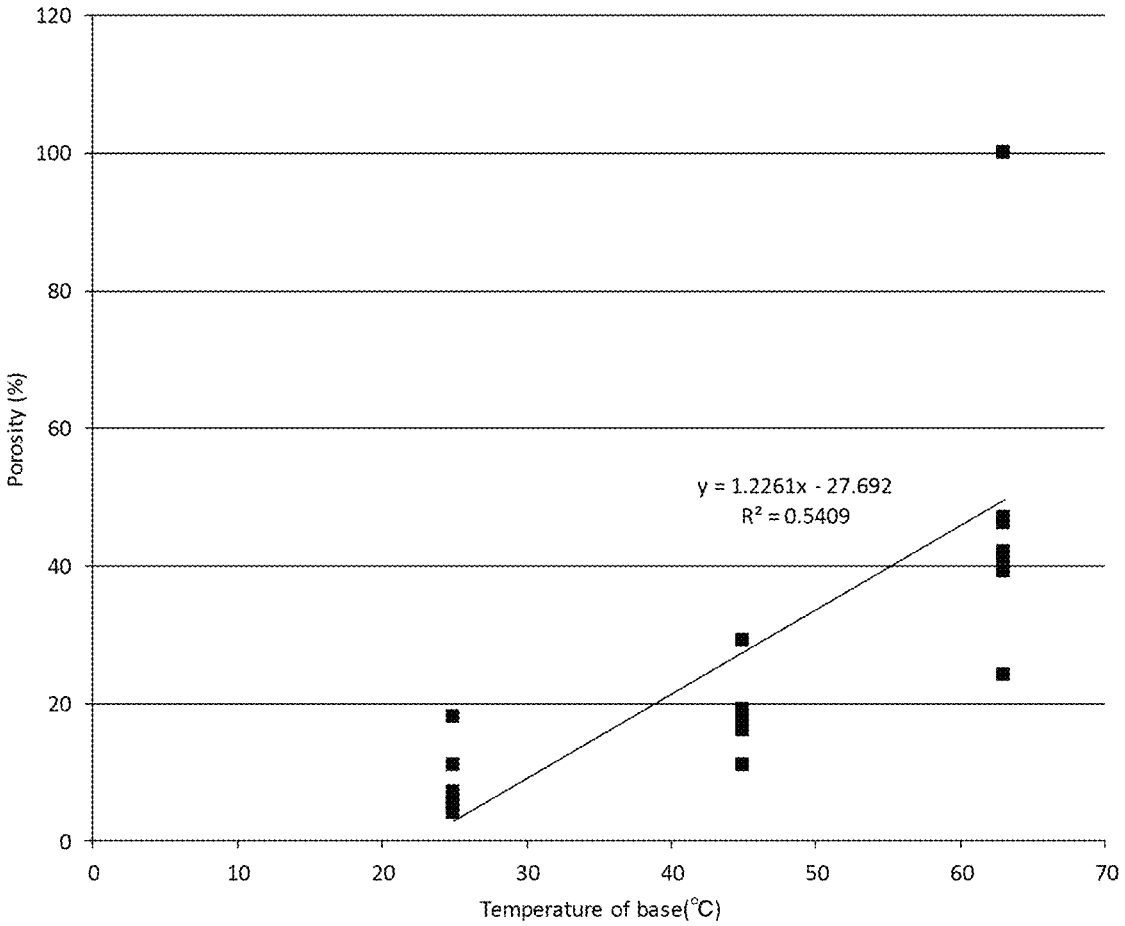
Application liquid with concentration of 200 g/lℓ

[FIG. 9-1]
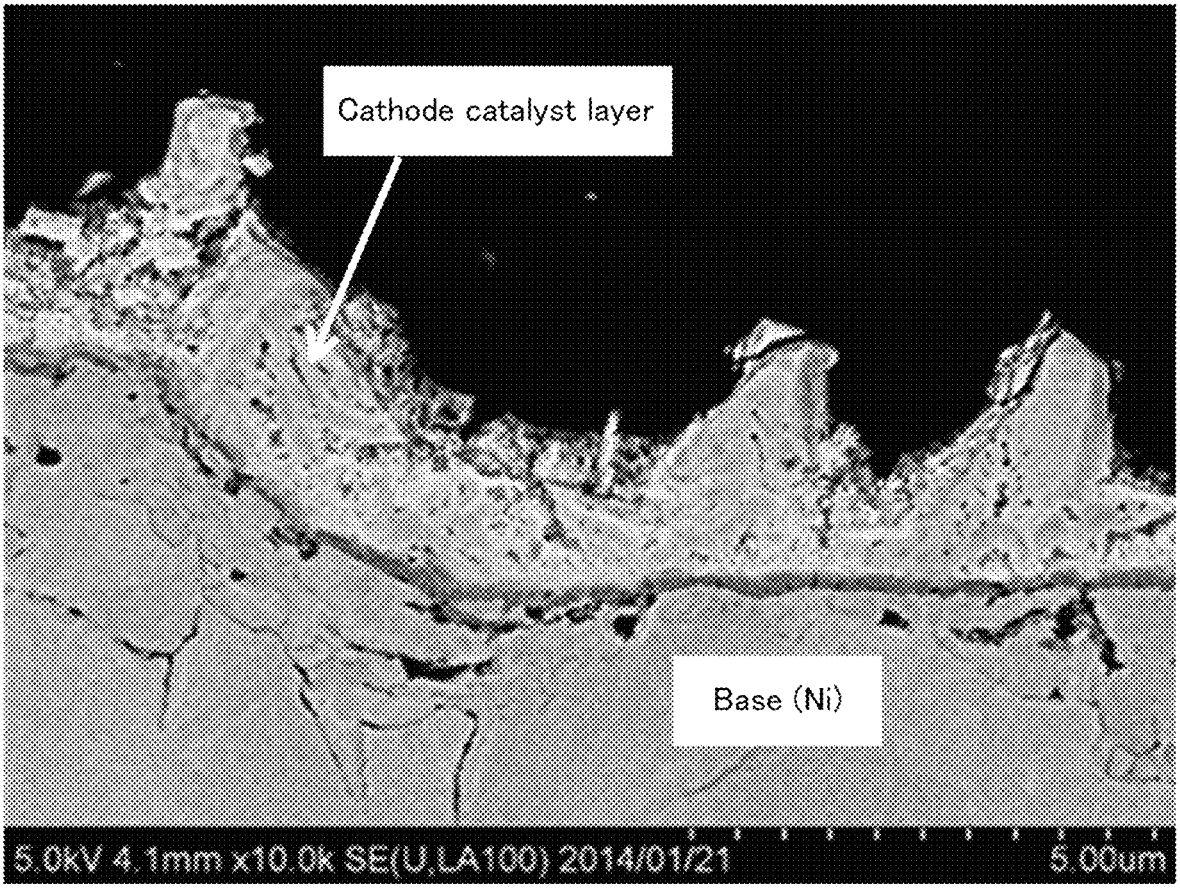

[FIG. 9-2]
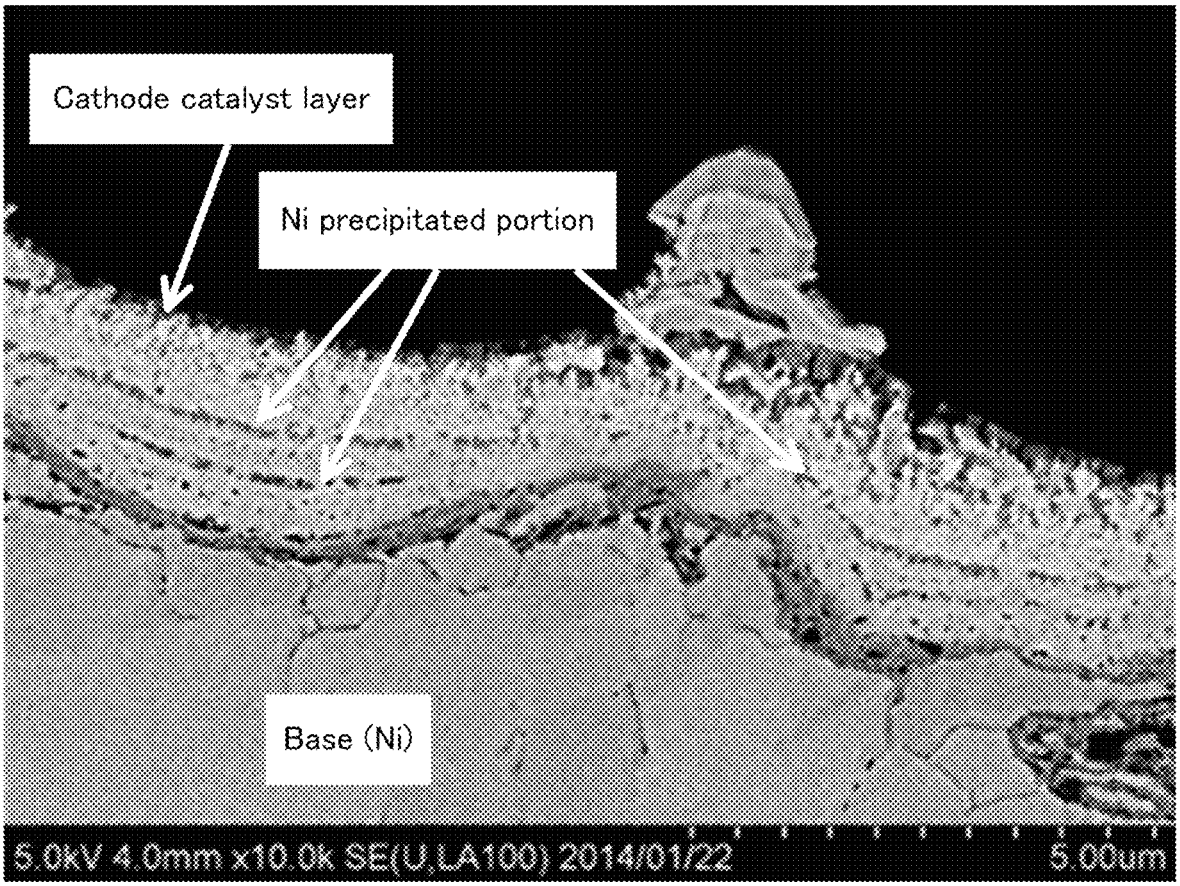

[FIG. 9-3]
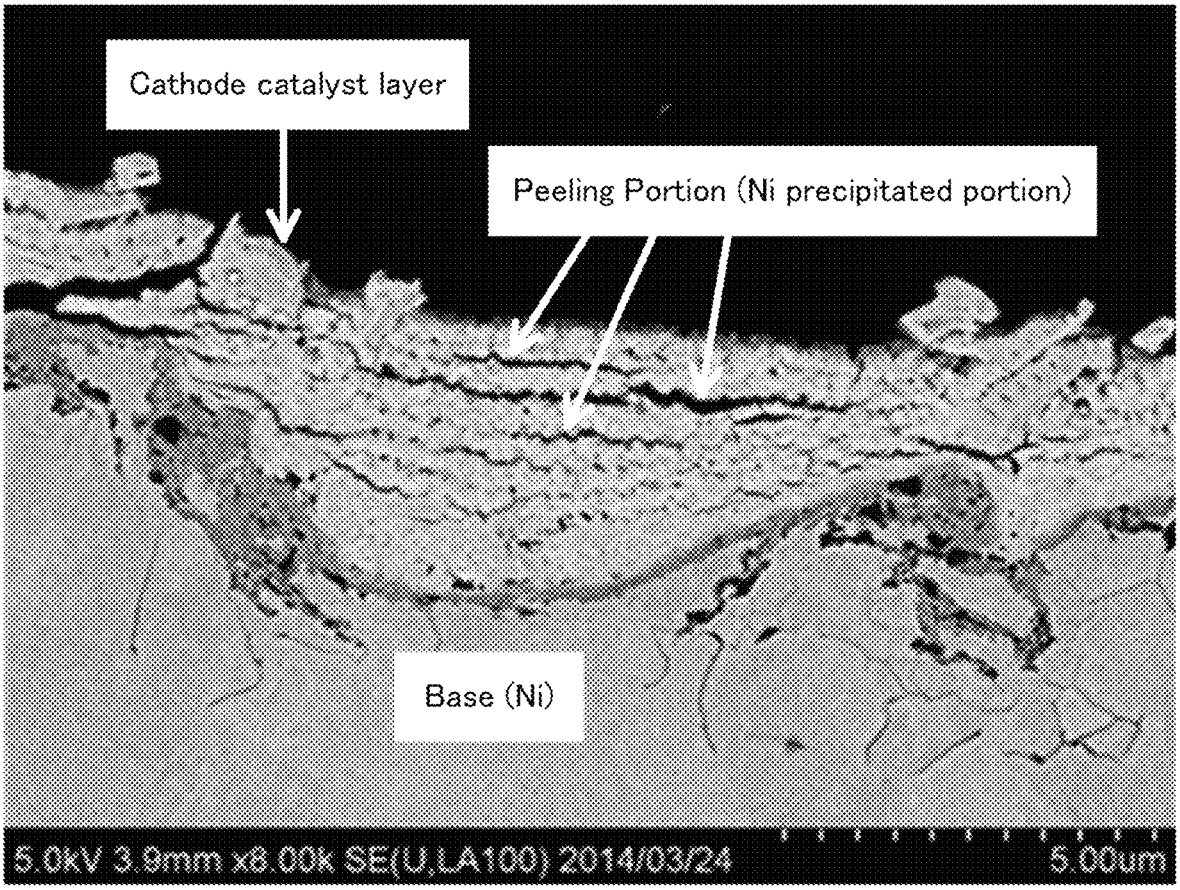

ELECTROLYSIS CATHODE AND METHOD FOR PRODUCING ELECTROLYSIS CATHODE

TECHNICAL FIELD

The present invention relates to a cathode for electrolysis which is used as a cathode of an electrolytic cell in soda electrolysis, water electrolysis, and various types of industrial electrolysis with oxygen generation and chlorine generation, and in which a cathode catalyst layer is formed on a conductive cathode base having a plurality of intersection portions between members, such as a wire mesh, expanded metal, perforated metal, or equivalents thereto, and a method for manufacturing the cathode for electrolysis.

BACKGROUND ART

For example, in recent years, in soda electrolysis, an ion-exchange membrane alkali chloride electrolytic cell for producing high-purity alkali metal hydroxide with high current efficiency and at a low voltage, particularly, a filter-press-type zero-gap electrolytic cell or a finite electrolytic cell in which an anode for electrolysis and a cathode for electrolysis come into contact with each other with an ion-exchange membrane interposed therebetween has been generally used.

When the cathode for electrolysis is used as a cathode for the ion-exchange membrane electrolysis, particularly, a cathode for a finite electrolytic cell or a zero-gap electrolytic cell, a conductive cathode base having a plurality of intersection portions between members (hereinafter, simply referred to as a "conductive cathode base having a plurality of intersection portions" or a "wire mesh-like cathode base"), such as a wire mesh, expanded metal, perforated metal, or equivalents thereto, is used as a conductive cathode base of the cathode for electrolysis. In general, a cathode catalyst layer is positively formed on one surface of the conductive cathode base having a plurality of intersection portions by an application method to manufacture a cathode, and the cathode is used with the side (cathode catalyst layer side) on which the cathode catalyst layer is formed coming into contact with one surface of the ion-exchange membrane or with a very small space therebetween. The anode for electrolysis comes into contact with a surface opposite to the ion-exchange membrane or a very small space is interposed therebetween.

In this type of electrolytic cell, in general, the base of the cathode is made of nickel or nickel alloy. The conductive cathode base having a plurality of intersection portions is used as the base of the cathode. A cathode catalyst layer including a cathode catalyst component which is expensive rare metal, such as platinum, is formed on at least one surface of the base.

For example, Patent Literature 1 discloses a method for manufacturing a cathode for electrolysis which is used in a zero-gap electrolytic cell in which an anode and a cathode come into contact with each other with an ion-exchange membrane interposed therebetween. In the manufacturing method, the following are described: the thickness of a conductive base having a plurality of intersection portions when the conductive base is used in the anode and the cathode; an aperture ratio; the thickness of a cathode catalyst layer; the thickness of an uneven portion in the surface of the cathode; and preprocessings such as a baking process, a shaping process, a planarizing process using rolling, a roughening process using a blast, a cleaning process with an acid, an etching process, and a process of improving corrosion resistance.

As disclosed in Patent Literature 1, in the related art, preprocessings, such as a baking process, a shaping process, a planarizing process using rolling, a roughening process using a blast, a cleaning process with an acid, an etching process, and a process of improving corrosion resistance, is performed for the conductive base having a plurality of intersection portions. Then, a cathode catalyst layer including a cathode catalyst component which is made of platinum-group metal and/or an oxide thereof is formed on one surface of the conductive base.

A step of forming the cathode catalyst layer is called an activation step. In the step, in general, an application liquid including a starting material which will be a cathode catalyst component (hereinafter, simply referred to as a starting material) is applied to the base and the application liquid applied to the base is dried and baked. Specifically, in the activation step, in general, first, an application liquid in which a starting material is dissolved is prepared. The application liquid is applied to one surface of the conductive base having a plurality of holes which has been subjected to preprocessing. Then, the application liquid is dried and baked to form a cathode catalyst layer. At that time, in order to forma desired cathode catalyst layer, the step of applying the application liquid and drying and baking the application liquid applied to the base is repeated a plurality of times until a desired amount of cathode catalyst component is attached to the front surface of the conductive cathode base. A cathode catalyst layer including a cathode catalyst component (a material forming a catalyst layer) which is expensive rare metal, such as platinum, is formed through the application, dry, and baking steps. The application step of applying the application liquid to the base is generally performed by methods using a roller and a spray, a brush application method, an electrostatic coating method, and other methods. In addition, in the baking step, heating is generally performed by, for example, an electric furnace.

CITATION LIST

Patent Literature

Patent Literature 1: JP 4453973 B1

SUMMARY OF INVENTION

Technical Problem

The inventors conducted an examination on a means for reducing or saving a catalyst layer on a base, without damaging the performance of a cathode, considering that a cathode catalyst component was very expensive rare metal, such as platinum, in the above-mentioned related art. From this point of view, particularly, the inventors conducted a thorough examination on a process of forming a cathode catalyst layer including a cathode catalyst component on the front and rear sides of a base, using a method that applied an application liquid including a starting material of the cathode catalyst component to a surface of a conductive cathode base and dried and baked the applied application liquid. As a result, the following findings were obtained.

(1) It was found that, when the conductive cathode base had a plurality of intersection portions between members, an excessive amount of application liquid was stagnated in the plurality of intersection portions in an application stage and a so-called liquid pool was formed. In addition, it was found that the liquid pool was solidified through a dry and baking step; an excessive amount of cathode catalyst component was fixed in the intersection portion of the conductive base; the excessive amount of cathode catalyst component fixed to the intersection portion due to the liquid pool did not effectively contribute to electrolysis; and the cathode catalyst component was at least an extra and unnecessary portion. Therefore, from the above-mentioned findings, the inventors recognized that, in a case in which an application liquid was attached to a conductive cathode base having a plurality of intersection portions between members, such as a wire mesh, when the generation of a liquid pool in a plurality of acute or right-angled intersection portions could be prevented or suppressed, it was possible to reduce the amount of expensive cathode catalyst component used and a large economic effect was obtained.

(2) It was found that nickel or a nickel component in a nickel alloy used as the conductive cathode base was likely to be precipitated as a "nickel layer" in the cathode catalyst layer. In addition, it was found that the "nickel layer" precipitated in the catalyst layer was likely to peel off when it was used as an electrode, caused an increase in the amount of expensive cathode catalyst used to form the cathode catalyst layer, and caused the damage of the durability of the electrode. It is considered that the reason is that, when the application liquid is an acid, nickel or nickel alloy used as the electrode base is corroded and dissolved by the application liquid and this phenomenon is particularly remarkable. When this problem can be solved, it is possible to improve the durability of an electrode and to improve the versatility of the application liquid for a cathode catalyst layer. This is very effective in industry.

In the above-mentioned electrolytic cell, precious metal, such as platinum, iridium, ruthenium, palladium, or osmium, and a rare earth element, such as lanthanum, cerium, yttrium, or praseodymium, are used as the cathode catalyst component of the cathode for electrolysis. These components are also rare and very expensive materials which are called rare metal or precious metal. The prices thereof are skyrocketing every year. The above-mentioned electrolytic cell is used in a large facility, such as an electrolysis facility of a large-scale chemical plant in the seaside district, and consumes a huge amount of cathode catalyst component. The proportion of the cost of the cathode catalyst component to the cost of manufacturing the electrolytic cell is very high. Therefore, reducing the cost of the expensive cathode catalyst component used to form the cathode catalyst layer is a goal of the industrial world using the electrolytic cell. Specifically, it is very important in industry to minimize the amount of cathode catalyst component used to forma catalyst layer and to use the formed catalyst layer for a long time.

In contrast, the technique according to the related art did not recognize resource saving based on the findings of the inventors that, when a cathode catalyst layer was formed on a conductive base having a plurality of intersection portions, such as a wire mesh, expanded metal, or perforated metal, by an application method, a liquid pool was likely to be formed in the plurality of intersection portions, and an excessive amount of cathode catalyst component that did not contribute to improving the performance of the cathode catalyst layer was fixed to the plurality of intersection portions due to the liquid pool. In addition, the technique according to the related art did not recognize another problem that the catalyst layer was likely to peel off due to the "nickel layer" precipitated in the catalyst layer and the "nickel layer" caused an increase in the amount of cathode catalyst consumed and the damage of durability. In the related art, an examination based on the recognition was not made at all. That is, even in survey in not only a cathode field, which is a target field of the invention, but also in the other technical fields, the technique according to the related art including Patent Literature 1 does not disclose or suggest an examination on a method, a means, and measures which are needed to optimize the amount of cathode catalyst component attached (fixed) to the conductive cathode base, and the amount of cathode catalyst consumed in terms of economical efficiency and performance including durability.

Accordingly, an object of the invention is to effectively prevent or suppress the generation of a liquid pool in a plurality of acute or right-angled intersection portions to reduce the amount of expensive cathode catalyst component used, and thereby when an application liquid including a cathode catalyst component is applied to the front and rear sides of a conductive cathode base having a plurality of intersection portions by an aforementioned application method. Another object of the invention is to prevent the cathode catalyst layer from peeling off when the cathode catalyst layer is used, to reduce the amount of cathode catalyst consumed, and to thereby improve the durability of the cathode for electrolysis. Specifically, an object of the invention is to provide a cathode for electrolysis that can reduce the amount of use of cathode catalyst component consisting of rare metal such as precious metal, without reducing the performance of the cathode when the cathode catalyst layer is formed, and can solve the problem that the catalyst layer peels off when the cathode is used, and to provide a method for manufacturing the cathode for electrolysis.

Solution to Problem

The above-mentioned objects are achieved by the following invention. In the invention, as a first means for solving the problems, there is provided a cathode for electrolysis including: a conductive cathode base that is a wire mesh, expanded metal or perforated metal, the wire mesh having a plurality of intersection portions between linear or strip-shaped members, the expanded metal and the perforated metal having right-angled or acute portions of holes as a plurality of intersection portions; and a cathode catalyst layer that includes a cathode catalyst component and is formed on the front and rear sides of the conductive cathode base by an application method which applies an application liquid including a starting material of the cathode catalyst component to a surface of the conductive cathode base, and dries and bakes the applied application liquid, wherein the cathode catalyst component includes at least one selected from platinum, iridium, ruthenium, palladium, osmium, nickel, and oxides thereof, the conductive cathode base is made of nickel or nickel alloy, a solidified portion of a liquid pool is not generated in the intersection portion of the conductive cathode base, or even if the solidified portion is generated, a cross-sectional shape of the solidified portion has mesh-shaped pores and the average porosity of the solidified portion is equal to or greater than 15%.

The essential structure of the first means for solving the problems, that is, "the solidified portion of the liquid pool is not generated in the intersection portion of the conductive cathode base; even if the solidified portion is generated, the cross-sectional shape of the solidified portion has mesh-shaped pores; and the average porosity of the solidified portion is equal to or greater than 15%" is achieved by preheating the conductive cathode base such that the temperature of the conductive cathode base immediately before the application liquid is applied is in the range of 43° C. to 120° C. and forming the cathode catalyst layer. In addition, it is possible to obtain the effect of preventing the problem that the cathode catalyst layer is likely to peel off due to precipitation of a "nickel layer" formed by nickel which is eluted from the base into the cathode catalyst layer.

In the cathode for electrolysis according to the invention, preferably, the average porosity is equal to or greater than 44%. The average porosity defined in the invention is an arithmetic mean value of porosity measured by a method which will be described below.

In the invention, as a second means for solving the problems which is another embodiment, there is provided a method for manufacturing the above-mentioned cathode for electrolysis. The manufacturing method includes a cathode catalyst layer forming step for forming a cathode catalyst layer including the cathode catalyst component on the front and rear sides of the conductive cathode base, the step comprising: applying an application liquid including a starting material of a cathode catalyst component to at least one surface of a conductive cathode base that is the wire mesh, the expanded metal or the perforated metal, the wire mesh having a plurality of intersection portions between linear or strip-shaped members, the expanded metal and the perforated metal having right-angled or acute portions of holes as a plurality of intersection portions; and thereafter drying and baking the application liquid applied to the base; the applying step, the drying step and the baking step being performed one time or plurality of times, wherein the cathode catalyst component includes at least one selected from platinum, iridium, ruthenium, palladium, osmium, nickel, and oxides thereof, the conductive cathode base is made of nickel or nickel alloy, and in the cathode catalyst layer forming step, the conductive cathode base is heated such that the temperature of the conductive cathode base immediately before the application liquid is applied one or more times is in the range of 43° C. to 120° C.

In the method for manufacturing the cathode for electrolysis, preferably, in the cathode catalyst layer forming step, a means for preheating the conductive cathode base is provided on an upstream side of the step of applying the application liquid, the series of the applying step of the application liquid, the drying and baking step of drying and baking the application liquid applied to the base is repeated a plurality of times, and whenever the steps are repeated, the conductive cathode base is heated by the preheating means such that the temperature of the conductive cathode base immediately before the application liquid is applied is in the range of 43° C. to 120° C. Preferably, the conductive cathode base is heated such that the temperature of the conductive cathode base immediately before the application liquid is applied is in the range of 43° C. to 63° C. Preferably, the application liquid is an acid.

For the temperature of the conductive cathode base immediately before the application liquid is applied which is defined in the above, 43° C. is a measured lower limit when the remarkable effect of the invention is obtained in a verification test. For example, 63° C. means the measured temperature with an error of ±1° C. This will be described below.

Advantageous Effects of Invention

According to the invention, in the cathode catalyst layer forming step, when a room-temperature application liquid including a cathode catalyst component is applied one or more times, preferably, whenever the room-temperature application liquid is applied, the conductive cathode base is heated such that the temperature of the conductive cathode base immediately before the application liquid is applied is in the range of 43° C. to 120° C., preferably, in the range of 43° C. to 63° C. Therefore, it is possible to reduce the amount of expensive cathode catalyst component used to form the cathode catalyst layer, using a very simple means, without reducing the performance of the cathode for electrolysis. Specifically, according to the invention, when an application liquid including a cathode catalyst component is applied to a surface of a conductive cathode base, such as a wire mesh, having a plurality of intersection portions by an application method to form cathode catalyst layers on the front and rear sides of the conductive cathode base, a solidified portion (extra and unnecessary portion) including an excessive amount of cathode catalyst component caused by a liquid pool of the application liquid is not generated in the plurality of intersection portions. Even if the solidified portion caused by the liquid pool of the application liquid is generated, the cross-sectional shape of the solidified portion has mesh-shaped pores in which a plurality of cavities can be observed, and an extra and unnecessary solidified portion is reduced. Therefore, the amount of expensive cathode catalyst component used to form the cathode catalyst layer is effectively reduced, as compared to the cathode catalyst layer according to the related art. As a result, it is possible to provide a cathode for electrolysis with high economic efficiency. In addition to the above-mentioned effect, according to the invention, the problem that the formed cathode catalyst layer is likely to peel of when it is used can be solved by a very simple means that heats the conductive cathode base such that the temperature of the conductive cathode base immediately before the application liquid is applied is in a specific range. As a result, it is possible to reduce the amount of cathode catalyst consumed during use. Therefore, it is possible to improve the durability of the cathode for electrolysis. As described above, according to the invention, it is possible to provide a cathode for electrolysis which can reduce the amount of expensive cathode catalyst component used to forma cathode catalyst layer, without reducing the performance of the cathode for electrolysis, has high economic efficiency, and is expected to improve the durability of the catalyst layer and a method for manufacturing the cathode for electrolysis.

BRIEF DESCRIPTION OF DRAWINGS

FIG. 1 is a process diagram schematically illustrating an embodiment of a method for manufacturing a cathode for electrolysis according to the invention.

FIG. 2-1 is a diagram illustrating an SEM image of the cross section of an intersection portion of a wire mesh base having a cathode catalyst layer formed thereon in a cathode for electrolysis according to Examples of the invention.

FIG. 2-2 is a diagram illustrating an SEM image of the cross section of an intersection portion of a wire mesh base having a cathode catalyst layer formed thereon in a cathode for electrolysis according to the related art.

FIG. 3 is a diagram illustrating a step of forming the cathode catalyst layer used in Examples and Comparative Examples and a step of manufacturing a sample for measuring porosity.

FIG. 4-1 is a diagram illustrating the cross section of a portion to which an excessive amount of cathode catalyst component is fixed (hereinafter, also referred to as a "solidified portion of a liquid pool") in an intersection portion of a wire mesh base having a cathode catalyst layer formed thereon in Example 3-1 and Example 3-2 in which a low-concentration application liquid is used and the temperature of the wire mesh base immediately before the application liquid is applied is 63° C., and the measurement state of porosity using image software for a binarization process.

FIG. 4-2 is a diagram illustrating the cross section of a "solidified portion of a liquid pool" in Example 3-3 and Example 3-4 in which a low-concentration application liquid is used and the temperature of a wire mesh-like base immediately before the application liquid is applied is 63° C., and a state when the porosity of the "solidified portion of the liquid pool" is measured using the image software for a binarization process.

FIG. 5 is a diagram illustrating the cross section of a "solidified portion of a liquid pool" in Example 4-2 and Example 4-4 in which a high-concentration application liquid is used and the temperature of a wire mesh-like base immediately before the application liquid is applied is 63° C., and a state when the porosity of the "solidified portion of the liquid pool" is measured using the image software for a binarization process.

FIG. 6-1 is a diagram illustrating the cross section of a "solidified portion of a liquid pool" in Comparative Example 1-1 and Comparative Example 1-2 in which a low-concentration application liquid is used and a wire mesh-like base to which the application liquid is applied is maintained at ambient temperature, and a state when the porosity of the "solidified portion of the liquid pool" is measured using the image software for a binarization process.

FIG. 6-2 is a diagram illustrating the cross section of a "solidified portion of a liquid pool" in Comparative Example 1-3 and Comparative Example 1-4 in which a low-concentration application liquid is used and a wire mesh-like base to which the application liquid is applied is maintained at ambient temperature, and a state when the porosity of the "solidified portion of the liquid pool" is measured using the image software for a binarization process.

FIG. 7 is a graph illustrating the relationship between the temperature of a base and porosity which is obtained by performing statistical analysis for data of eight porosities obtained in each of Examples 1 and 3 and Comparative Example 1, in which the temperature of a wire mesh-like base immediately before a low-concentration application liquid is applied is changed between ambient temperature and 63° C. under the condition in which 100 g/L of low-concentration application liquid is applied in an application step.

FIG. 8 is a graph illustrating the relationship between the temperature of a base and porosity which is obtained by performing statistical analysis for data of eight porosities obtained in each of Examples 2 and 4 and Comparative Example 2, in which the temperature of a wire mesh-like base immediately before a high-concentration application liquid is applied is changed between ambient temperature and 63° C. under the condition in which 200 g/L of high-concentration application liquid is applied in the application step.

FIG. 9-1 is a diagram illustrating an SEM image of the cross section of a cathode catalyst layer before electrolysis in a cathode for electrolysis according to an example of the invention, which is manufactured by heating a conductive cathode base using a method according to the invention such that the temperature of the conductive cathode base immediately before an application liquid is applied is 43° C.

FIG. 9-2 is a diagram illustrating an SEM image of the cross section of a cathode catalyst layer before electrolysis in a cathode for electrolysis according to a comparative example, which is manufactured while the temperature of a conductive cathode base immediately before an application liquid is applied is maintained at room temperature (ambient temperature), without using the method according to the invention.

FIG. 9-3 is a diagram illustrating an SEM image of the cross section of a cathode catalyst layer after electrolysis illustrated in Table 5 in a cathode for electrolysis according to a comparative example, which is manufactured while the temperature of a conductive cathode base immediately before an application liquid is applied is maintained at room temperature (ambient temperature), without using the method according to the invention.

DESCRIPTION OF EMBODIMENTS

Hereinafter, preferred embodiments of a cathode for electrolysis and a method for manufacturing the cathode for electrolysis according to the invention will be described in detail.

(1) First, a method for manufacturing a cathode for electrolysis according to the invention will be described. The manufacturing method simply manufactures the cathode for electrolysis which includes a cathode catalyst layer formed by applying an application liquid including a raw material of a cathode catalyst component to a conductive cathode base made of nickel or nickel alloy and drying and solidifying the application liquid. In the manufacturing method, an extra and unnecessary portion (a "solidified portion of a liquid pool") of the cathode catalyst layer is not generated in an intersection portion between members of the cathode base. It is possible to reduce the amount of cathode catalyst component which is excessively fixed and to reduce the amount of expensive cathode catalyst component used. As described above, an object of the invention is to solve the technical problems which arise when the cathode catalyst layer is formed on at least one surface of the conductive cathode base having a plurality of intersection portions by an application method and have been newly found by the inventors. In the invention, the above-mentioned technical problems are solved by a new structure which heats a conductive cathode base such that the temperature of the conductive cathode base immediately before an application liquid including a raw material of a cathode catalyst component is applied is in the range of 43° C. to 120° C. when the application liquid is applied one or more times, preferably, whenever the application of the application liquid is repeated in a step of forming the cathode catalyst layer on the conductive cathode base and the above-mentioned remarkable effect is achieved by the new structure. Therefore, the manufacturing method according to the invention is basically the same as a method for manufacturing a cathode for electrolysis according to the related art except for the above-mentioned structure.

(2) According to the manufacturing method of the invention, the following technical problems in the cathode for electrolysis which have not been considered in the related art are solved. As described above, the inventors found that, in a case in which an application liquid including a starting material, such as precious metal, an oxide thereof, or nickel oxide, was applied to a surface of a cathode base made of nickel or nickel alloy and was dried and solidified to form a cathode catalyst layer, when the application liquid was particularly an acid, a nickel component was likely to be precipitated as a "nickel layer" in the cathode catalyst layer. That is, in some cases, when the cathode catalyst layer is formed by an "application and thermal decomposition method" according to the invention which applies, dries, and solidifies an application liquid, a nickel component in the cathode base is melt and is precipitated as a nickel precipitate in the cathode catalyst layer. The nickel precipitate is baked into a nickel layer. When there is a nickel layer in the cathode catalyst layer of the cathode, the elution of the nickel layer in an electrolytic solution is accelerated by electrolysis for a long time or by reverse electrolysis for a short time, and thereby the cathode catalyst layer peels off. The inventors found that the appearance of the "nickel layer" was prevented by the manufacturing method according to the invention. The inventors considered that the reason was as follows: when the base was heated in a specific temperature range immediately before the application liquid was applied, the evaporation of the application liquid was accelerated, and the application liquid was dried quickly on the cathode base, which made it possible to reduce the contact time between the acid application liquid and the base; and, as a result, the nickel component in the cathode base was effectively prevented from being precipitated as a "nickel layer" in the cathode catalyst layer. Therefore, as a means for accelerating the drying of the application liquid, when a liquid including alcohol with high volatility or an organic solvent is used as the application liquid, it is possible to accelerate the drying of the application liquid on the cathode base. As a result, it is possible to form the cathode catalyst layer that can solve the above-mentioned problems.

When the cathode catalyst layer is formed by the problematic application method in the invention, it is necessary to use an application liquid in which a raw material including a catalyst component, such as precious metal, precious metal oxide, or nickel oxide, is uniformly dissolved. Chloride, sulfate, or nitrate is used as the raw material as described below. An acid solvent, such as hydrochloric acid, sulfuric acid, or nitric acid, is generally used as the solvent, and the application liquid is generally an acid. As described above, according to the manufacturing method of the invention, when the cathode catalyst layer is formed on the surface of the cathode base made of nickel or nickel alloy, using the application liquid including a starting material, such as precious metal, precious metal oxide, or nickel oxide, the following problem can be solved: a nickel layer is likely to be precipitated in the cathode catalyst layer by electrolysis for a long time or reverse electrolysis for a short time which is particularly remarkable when an acid application liquid is used; and thereby the cathode catalyst layer peels off, which results in an increase in the amount of cathode catalyst consumed.

Hereinafter, the conductive cathode base corresponding to the technical problem of the invention will be described.

Conductive Cathode Base

In the invention, the conductive cathode base is made of nickel or nickel alloy. In addition, the conductive cathode base (hereinafter, also referred to as a "conductive base") is, for example, a wire mesh, expanded metal, perforated metal, or equivalents thereto having a plurality of intersection portions between members. This is because this point is the problem to be solved in the invention. That is, when an application liquid including a cathode catalyst component is applied to the conductive cathode base, for example, a liquid pool is generated in an intersection portion between members, such as linear metal portions forming a wire mesh. The liquid pool causes an excessive amount of cathode catalyst component to be fixed to the intersection portion. However, the "solidified portion of the liquid pool" does not contribute to improving the performance of the cathode and causes the waste of an expensive material. Therefore, an object of the invention is to minimize the "solidified portion of the liquid pool".

In the invention, the intersection portion means, for example, an intersection portion between linear or strip-shaped metal members forming a wire mesh or a right-angled or acute portion of a hole in expanded metal or perforated metal. The intersection angle is not particularly limited and needs to be an angle at which a liquid pool is likely to be generated when an application liquid including a cathode catalyst component is applied to the base in a normal state, considering the above-mentioned object. The following wire mesh is given as an example: a wire mesh in which an angle formed between metal wires, which are metal members, in the vertical and horizontal directions is 90 degrees and the mesh shape of an opening portion is a square shape or a rectangular shape; or a wire mesh in which there are portions that intersect with each other at an angle less than 90 degrees in an intersection portion between metal wires and at least a part of an opening portion has a mesh shape, such as a triangular shape, a rhombus shape, or a trapezoidal shape.

An example in which metal wires which are metal members intersect each other has been described above. However, the metal wire is not limited to the wire having a circular shape in a cross-sectional view and may be a wire having an elliptical shape or a polygonal shape in a cross-sectional view or a flat wire. In addition, strip-shaped metal plate may intersect each other. The metal wire is not limited to the linear wire and may be a wire with an uneven portion or a zigzag wire. The thickness of the member, such as a metal wire, is not particularly limited. Any metal wire according to the related art may be used as long as it is a conductive base with a wire mesh shape or a shape similar to the mesh shape. The overall shape of the conductive base is not particularly limited. In general, a plain-woven plate is used as the conductive base. However, the conductive base is not particularly limited to a flat plate and may have an appropriate curve according to the purpose of use. Of course, the conductive base is not limited to the plain-woven plate and the size of the opening thereof is not particularly limited. In the invention, the following is important: when an application liquid including a starting material of a cathode catalyst component is applied onto at least one surface of a target conductive base, a liquid pool is generated at an intersection portion between members. In other words, the technique according to the invention is not limited to a case in which an application liquid including a cathode catalyst component is applied to a conductive base defined by the invention to form a cathode catalyst layer. The invention provides a technique which can be used in a case in which an application liquid including an expensive rare metal component needs to be applied to at least one surface of a wire mesh-like base to form a layer, can reduce the waste of an expensive component, and is useful in all fields in terms of resource saving. According to the invention, it is possible to prevent a solidified portion caused by a liquid pool from being generated at an intersection portion between members. Therefore, it is useful to improve the design according to circumstances.

The conductive base having a plurality of intersection portions is made of nickel or nickel alloy. Preferably, the conductive base has a specific surface area of 1.1 $m^2$ to 2.4 $m^2$ (an actual surface area per 1 $m^2$ of projection area) and a thickness of about 0.1 mm to 0.8 mm. Next, a method for manufacturing the cathode for electrolysis will be described in brief and a cathode catalyst layer which is a characteristic portion of the cathode for electrolysis according to the invention and a step of forming the cathode catalyst layer will be described.

Method for Manufacturing Cathode for Electrolysis

1. Preprocessing Step

FIG. 1 illustrates an example of a manufacturing process of the method for manufacturing the cathode for electrolysis according to the invention. As illustrated in FIG. 1, before a step of forming the cathode catalyst layer, a preprocessing step may be performed for the conductive base. For example, each step of the manufacturing process according to the related art which is represented by 1 in FIG. 1 may be performed as the preprocessing step. Of course, the preprocessing step is not limited to the preprocessing illustrated in FIG. 1.

2. Cathode Catalyst Layer Forming Step

The method for manufacturing the cathode for electrolysis according to the invention is characterized by a cathode catalyst layer forming step which is represented by 2 in FIG. 1. In the step, an application, drying, and baking step of applying an application liquid including a starting material of a cathode catalyst component (hereinafter, simply referred to as a "catalyst component") to at least one surface of the conductive base having a plurality of intersection portions and drying and baking the application liquid applied to the base is performed one time or a plurality of times to form a cathode catalyst layer (hereinafter, simply referred to as a "catalyst layer"). The inventors found the following: in a method according to the related art, since the conductive base to which an application liquid was applied was a wire mesh-like base with a large surface area, as described above, the conductive base was rapidly naturally cooled after baking; and, in a case in which the above-mentioned series of processes was repeatedly performed a plurality of times, when the application liquid was applied again, the temperature of the conductive base immediately before the application liquid was applied was close to ambient temperature (room temperature) and was not a high temperature of at least 43° C. or more. In contrast, in the manufacturing method according to the invention, in the cathode catalyst layer forming step, when the application liquid is applied one or more times, preferably, whenever the application liquid is applied, the conductive base is heated such that the temperature of the conductive base immediately before the application liquid is applied is in the range of 43° C. to 120° C., preferably, in the range of 43° C. to 63° C. in terms of the balance between the effect to be obtained and the cost required to increase temperature. According to this structure, it is possible to obtain a cathode for electrolysis that is more economical than that in the related art. As described above, in the method according to the related art, the temperature of the conductive base immediately before the application liquid is applied is not controlled and the application liquid is applied to the conductive base at ambient temperature (room temperature) which is not a high temperature of at least 43° C. or more. The inventors found a new technique which heated a wire mesh-like conductive base such that the temperature thereof immediately before an application liquid was applied was greater than that in the related art to reduce the amount of expensive cathode catalyst component used to form a cathode catalyst layer and the invention was achieved by the findings, which will be described below.

In the cathode catalyst layer forming step, a preheating step having a means for heating the conductive base is provided on the upstream side of the step of applying the application liquid in order to effectively and certainly obtain the effect of the invention. In addition, in order to form a catalyst layer with a desired thickness, a series of steps of applying the application liquid and drying and baking application liquid is repeatedly performed a plurality of times. In this case, it is desirable that, whenever the application liquid is applied, the conductive base is heated by a preheating means such that the temperature of the conductive base immediately before the application liquid is applied is certainly in the range of 43° C. to 120° C. and preferably in the range of 43° C. to 63° C. Next, the procedure of the method for manufacturing the cathode for electrolysis according to the invention having the above-mentioned structure will be described with reference to FIG. 1 which is a diagram schematically the steps. The remarkable effect of the invention is easily obtained as long as the range of the conductive base immediately before the application liquid is applied can be in the range of 43° C. to 120° C. Therefore, the preheating step using the preheating means is not particularly limited as long as the above-mentioned point can be achieved.

In the method illustrated in FIG. 1, a preheating step (2-1) having a means for preheating the conductive base, which has not been provided in the method according to the related art, is provided before an application step (2-2) of applying an application liquid including a catalyst component to the conductive base and the preheating means is used to heat the conductive base such that the temperature of the conductive base immediately before the application liquid is applied is in the range of 43° C. to 120° C. As illustrated in FIG. 1, after the application step (2-2) of applying the application liquid to the conductive base heated to a specific temperature is performed, a catalyst layer is formed on the conductive base through a dry step (2-3) and a baking step (2-3).

When the catalyst layer is formed on the conductive base, in order to adjust the thickness of the catalyst layer to have a desired thickness, in general, these steps are repeatedly performed to form the catalyst layer with a desired thickness. In the manufacturing method according to the invention, it is preferable that the preheating step (2-1) be performed before the application step (2-2) whenever the application liquid is applied. That is, according to this structure, when the application liquid is applied, the temperature of the conductive base is always in the range 43° C. to 120° C. and preferably in the range of 43° C. to 63° C. Therefore, whenever the application liquid is applied, a solidified portion of a liquid pool formed at an intersection portion of the conductive base is not generated or it is possible to reduce the use amount of expensive catalyst component which is excessively fixed in the portion. Therefore, it is possible to improve the effect of the invention. Of course, even in a case in which the above-mentioned steps are repeated, when the conductive base is heated at least one time, the waste of the catalyst component can be less than that in the related art. Therefore, it is possible to obtain the effect of the invention. However, in order to further improve the effect, it is preferable that, whenever the application step (2-2) is performed, the temperature of the conductive base immediately before the application liquid is applied be in the range of 43° C. to 120° C. According to this structure, it is possible to reduce the waste of the cathode catalyst component used to form the cathode catalyst layer whenever the application step is performed.

In the invention, the time when preheating is performed and the number of times preheating is performed may be appropriately determined to form catalyst layers including a desired amount of catalyst component on the front and rear surfaces of the base. That is, the inventors found that, during the application of the application liquid to the front surface of the conductive base, when the conductive base was preheated, the applied application liquid was quickly dried and the time required to fix a catalyst layer forming material in the liquid to the front side was reduced. As a result, it is possible to reduce the amount of application liquid transferred to the rear side of the wire mesh-like base through, for example, holes and to effectively control the amount of catalyst layer forming material moved and fixed to the rear side. Therefore, the amount of catalyst component in the cathode catalyst layer formed on the front side is certainly more than the amount of catalyst component in the cathode catalyst layer formed on the rear side of the base through, for example, the holes of the base, as compared to a case in which the application liquid is applied to the conductive base, without performing preheating, and is then dried and baked.

In the method according to the invention, the preheating step is preferably performed at least one time before the step of applying the application liquid. The preheating step may be performed a plurality of times before the application step. The time when preheating is performed is not necessarily performed in the first step. For example, in the first step, a series of application, dry, and baking steps may be performed without performing preheating, and then preheating may be performed. In addition, after a series of application, dry, and baking steps is performed a plurality of times, preheating may be performed and then the series of application, dry, and baking steps may be performed. The preheating is preferably performed one or more times. In this case, the preheating may be certainly performed before the application liquid is applied in each application step. According to the examination results of the inventors, the number of times preheating is performed and the time when preheating is performed may be adjusted to control the amount of application liquid including a starting material of an electrode catalyst component which is attached to the rear side of the conductive base through the holes or the upper, lower, left, and right ends of the conductive base. As a result, the amount of catalyst component in the cathode catalyst layer formed on the rear side of the conductive electrode base with respect to the amount of catalyst component in the cathode catalyst layer formed on the front side of the conductive base is reduced as the number of times preheating is performed increases. That is, it is possible to increase the ratio of the amount of catalyst component attached to the front surface of the conductive base to the amount of catalyst component in the cathode catalyst layer formed on the rear surface of the conductive base and to appropriately control the degree of the increase.

As described above, an economical cathode for electrolysis according to the invention in which the amount of catalyst component used to form the cathode catalyst layer is reduced can be very easily and reliably obtained by the method for manufacturing the cathode for electrolysis according to the invention in which the preheating step (2-1) having a preheating means is provided in the cathode catalyst layer forming step and the conductive base maintained at a temperature equal to or less than ambient temperature is heated when the application liquid is applied one or more times, preferably, whenever the application liquid is applied such that the temperature of the conductive base immediately before the application liquid including the catalyst component is applied is in the range of 43° C. to 120° C. In addition, according to the examination results of the inventors, when the above-mentioned effect and the cost required for heating are considered, it is more preferable that the temperature of the conductive base immediately before the application step be in the range of 43° C. to 63° C. In this case, it is possible to economically form an appropriate cathode catalyst layer. Hereinafter, an example of the preheating step (2-1) that is provided in the cathode catalyst layer forming step, which is a characteristic portion of the invention, in order to heat the conductive base such that the temperature of the conductive base immediately before the application liquid is applied is in the range of 43° C. to 120° C. will be described. In addition, the effect obtained when the temperature of the conductive base immediately before the application liquid is applied is in the range defined by the invention will be described in detail.

2-1: Preheating Step

As described above, the method for manufacturing the cathode for electrolysis according to the invention is characterized in that, in the catalyst layer forming step of forming the cathode catalyst layer on at least one surface of the conductive base, the conductive base is heated such that the temperature of the conductive base immediately before the application liquid is applied one or more times is in a specific temperature range. The other steps may be the same as those in the cathode catalyst layer forming method in the method for manufacturing a cathode for electrolysis according to the related art. Specifically, in the related art, when a cathode catalyst layer is formed on the surface of the conductive base (wire mesh-like base) having a plurality of intersection portions, a series of application, dry, and baking steps of applying an application liquid including a starting material of a catalyst component to a front surface of the base and drying and baking the application liquid is repeatedly performed a plurality of times to form a cathode catalyst layer with a desired thickness, which includes a desired amount of cathode catalyst component, on the surface of the base. The method according to the invention is basically the same as that according to the related art. The manufacturing method according to the invention is characterized in that, when a series of application, dry, and baking steps is repeatedly performed a plurality of times, the conductive base is heated such that the temperature of the conductive base immediately before the application liquid is applied one or more times is in a range of 43° C. to 120° C. and the application liquid is applied to the base.

According to the examination results of the inventors, when a wire mesh-like base is heated such that the temperature of the base immediately before the application liquid is applied is in a range of 43° C. to 120° C., the application liquid including the starting material applied to the surface of the base is dried quickly and the spreading of the application liquid on the surface of the base is prevented. As a result, a liquid pool is less likely to be generated in an intersection portion. In addition, even if a liquid pool is generated, the amount of catalyst component stagnated in an intersection portion of the wire mesh-like base is certainly less than that when the preheating step is not performed. As a result, when the application liquid is applied, dried, and baked to form a catalyst layer, an excessive "solidified portion of the liquid pool" which is caused by the liquid pool generated when the application liquid is applied is not generated in a plurality of intersection portions of the conductive base. Even if the excessive "solidified portion of the liquid pool" which is caused by the liquid pool is generated, the solidified portion has a cross-sectional shape which includes a plurality of mesh-shape hollow pores and the amount of catalyst component used is reduced.

FIGS. 2-1 and 2-2 illustrate an SEM image of an aspect of the "solidified portion of the liquid pool". FIG. 2-1 is a diagram illustrating an SEM image of the cross section of the intersection portion when the preheating step is provided, the wire mesh-like base is heated such that the measured temperature of the base immediately before the application liquid is applied is about 63° C., and the application liquid is dried and baked to form a catalyst layer. All of the SEM images show the results of the test in which application liquids including catalyst components with the same concentration of 100 g/L are used and nickel plain-woven wire meshes (ϕ0.15×40 meshes) that are made of the same material and have the same shape are used as the conductive base. In the diagram, data in the upper and lower stages are obtained by the test on different days. Data on the left and right side in the upper and lower stages of FIG. 2-1 are the diagrams illustrating the SEM image of the cross section of the intersection portion between nickel wires when an observation position is changed in the test performed on the same day. FIG. 2-2 is a diagram illustrating an SEM image when a catalyst layer is formed under the same conditions as those in FIG. 2-1 except that the preheating step is not provided. Data in the upper and lower stages are obtained by the test on different days. Samples for the SEM images illustrated in FIGS. 2-1 and 2-2 were manufactured by forming a cathode catalyst layer, cutting out a portion including the intersection portion of the conductive base from the cathode for electrolysis, inserting the cut portion into a transparent resin in the vertical direction, solidifying the cut portion, cutting and polishing the intersection portion, and observing the cut plane of the base. The samples will be described in detail below.

The comparison between the SEM images proved that, in particular, the state of the catalyst layer formed in the intersection portion between the nickel wires forming the wire mesh was certainly changed depending on whether the preheating step was performed. Specifically, when the outward appearance of the product according to the invention is observed, a solidified portion caused by a liquid pool of the application liquid in the intersection portion between the nickel wires is certainly less than that in the product according to the related art. In addition, the solidified portion of the liquid pool is hardly generated in some cases. Specifically, as can be seen from the diagram illustrating the SEM image of the cross section of the intersection portion illustrated in FIG. 2-1, in the cathode for electrolysis according to the invention, when a solidified portion of a liquid pool is present in the intersection portion of the catalyst layer, the solidified portion has a cross-sectional shape in which a plurality of hollow pores are arranged in a mesh shape and is certainly different from the solidified portion of the liquid pool in the cathode for electrolysis according to the related art illustrated in FIG. 2-2. In some cases, a hole is formed in the solidified portion of the liquid pool in the cathode for electrolysis according to the related art. However, as illustrated in FIG. 2-2, unlike the cathode for electrolysis according to the invention, the solidified portion does not have mesh-shaped hollow pores. Therefore, when the cross-sectional shape of the intersection portion between members in the conductive base having the catalyst layer formed thereon can be observed by the same process as described above to simply determine whether a cathode for electrolysis corresponds to the cathode for electrolysis according to the invention or the cathode for electrolysis according to the related art.

The inventors conducted a thorough examination on the effect obtained by performing the preheating step for the conductive base (wire mesh-like base) with a wire mesh shape immediately before the application liquid was applied. Specifically, the inventors conducted a thorough examination on a change in the state of the catalyst layer formed in the intersection portions of the wire mesh while changing the temperature of the wire mesh-like base immediately before the application liquid was applied, using preheating. The examination results proved that, when the temperature of the wire mesh-like base having the application liquid applied thereon was equal to or higher than a certain temperature, the applied application liquid was quickly dried; after the application liquid was baked and solidified, the spreading of the applied application liquid was prevented; and the amount of catalyst component used was certainly less than that in the related art, particularly, in the solidified portion of the liquid pool generated in the intersection portion of the wire mesh. In addition, as described above, the reduction effect varied depending on the temperature of the wire mesh-like base immediately before the application liquid was applied.

According to the thorough examination results of the inventors, when the temperature of the wire mesh-like base immediately before the application liquid is applied is in the range of 43° C. to 120° C., the cross-sectional shape of the "solidified portion of the liquid pool" in which an excessive amount of cathode catalyst component is fixed in the catalyst layer formed at the intersection portion between members certainly has a plurality of mesh-shaped hollow pores illustrated in FIG. 2-1. As a result, it is possible to reliably reduce the amount of cathode catalyst component used. In order to objectively determine the conditions capable of obtaining the effect of the invention, the inventors calculated porosity in the cross section of the "solidified portion of the liquid pool" using a method, which will be described below, and confirmed the above-mentioned temperature range. This will be described below in Examples.

The inventors found that, when the preheating step which had not been performed in the manufacturing method according to the related art was performed for the wire mesh-like base, average porosity in the cross section of the "solidified portion of the liquid pool" in which an extra catalyst component was fixed and which was generated in the intersection portion of the wire mesh-like base was equal to or greater than 15% in the cathode for electrolysis according to the invention. In addition, the inventors found that it was possible to remove 100% of the "solidified portion of the liquid pool", that is, completely remove the "solidified portion of the liquid pool" in the intersection portion, which was the problems to be solved in the invention, according to conditions. Therefore, the cathode for electrolysis according to the invention is economical since the amount of expensive cathode catalyst component used to form the catalyst layer is effectively reduced. That is, as the average porosity increases, the amount of cathode catalyst component, such as precious metal, which is used for coating is reduced. Therefore, it is preferable that the conditions of the preheating step be determined such that average porosity in the cross section of the "solidified portion of the liquid pool" is high, in order to further improve the effect of the invention. In this case, it is possible to more effectively reduce the amount of expensive cathode catalyst component used to form the catalyst layer and thus to improve the economic efficiency of the cathode for electrolysis.

As described above, in the invention, in the cathode catalyst layer forming step, when a room-temperature application liquid including a cathode catalyst component is applied one or more times, preferably, whenever the application liquid is applied, the conductive cathode base is heated such that the temperature of the conductive cathode base immediately before the application liquid is applied is in the range of 43° C. to 120° C. According to this structure, a solidified portion of a liquid pool is not formed in the intersection portion of the conductive cathode base. When the solidified portion of the liquid pool is formed in the intersection portion, the solidified portion has a cross-sectional shape which has mesh-shaped pores and in which average porosity is equal to or greater than 15%. In addition, a nickel component of the conductive cathode base is not eluted into the cathode catalyst layer and a nickel precipitate is not formed in the cathode catalyst layer. As a result, the peeling of the cathode catalyst layer caused by a nickel precipitate or a nickel layer is prevented.

The cathode catalyst component used in the invention includes at least one of platinum, iridium, ruthenium, palladium, osmium, nickel, and oxides thereof and includes a rare earth element, such as lanthanum, cerium, or yttrium, valve metal, such as titanium or tantalum, or oxides thereof. All of the components are expensive rare metal materials. In contrast, in the cathode for electrolysis according to the invention, the amount of cathode catalyst component used to form the catalyst layer is effectively reduced. Therefore, in the cathode for electrolysis according to the invention, the cost of the expensive rare metal materials is certainly less than that in the product according to the related art. As a result, the cathode for electrolysis according to the invention has high economic efficiency.

Next, the preheating step will be described in detail.

Temperature Range

The cathode for electrolysis according to the invention which has high economic efficiency is easily obtained by heating the wire mesh-like base such that the temperature of the wire mesh-like base immediately before the application liquid is applied is in the range of 43° C. to 120° C. in the preheating step that is performed for the wire mesh-like base before the application step. When the temperature is less than 43° C., a remarkable effect is not obtained. When the temperature is greater than 120° C., for example, is close to the boiling point of the application liquid, the application liquid is evaporated and it is necessary to heat the wire mesh-like base such that the temperature of the wire mesh-like base is significantly less than the boiling point of the application liquid. The critical temperature range defined by the invention is verified by experiments. According to the thorough examination results of the inventors, the lower limit of the temperature at which the remarkable effect of the invention is obtained is 43° C. In addition, as the temperature increases, the "solidified portion of the liquid pool", which is the problem to be solved in the invention, tends to be reduced and a remarkable effect is obtained at 120° C. However, as illustrated in Examples, the effect of reducing the cathode catalyst component is remarkable at a temperature of about 63° C. When the cost of heating is considered, it is preferable that the temperature of the wire mesh-like base immediately before the application liquid is applied be about 63° C.

In the preheating step, when the temperature of the wire mesh-like base immediately before the application liquid is applied is less than 43° C., the following problems arise.

(1) When the conductive cathode base has a plurality of intersection portions between members, an excessive amount of application liquid is stagnated in the plurality of intersection portions in an application stage and a so-called liquid pool is formed. Then, the liquid pool is solidified through a dry and baking step. As a result, an excessive amount of cathode catalyst component is fixed in the intersection portion of the conductive base. The excessive amount of cathode catalyst component fixed to the intersection portion due to the liquid pool does not effectively contribute to electrolysis. The cathode catalyst component is at least an extra and unnecessary portion.

(2) When the application liquid is applied to a nickel base, the phenomenon in which the application liquid comes into direct contact with the nickel base or is infiltrated into the cathode catalyst layer and then comes into contact with the nickel base is maintained up to the next step, that is, the dry step. Therefore, in particular, when the application liquid is acid, the nickel base is eluted into the application liquid film formed on the lower surface of the nickel base or into the semi-dried application liquid and a nickel layer is formed in the cathode catalyst layer in the baking step. The elution of the layer is accelerated by electrolysis for a long time or reverse electrolysis for a short time and the peeling of the cathode catalyst layer starts from the void. As a result, the amount of cathode catalyst consumed increases.

In contrast, when the temperature of the wire mesh-like base immediately before the application liquid is applied is equal to or greater than 43° C. in the preheating step, the following remarkable effects are obtained.

(1) When an application liquid including a cathode catalyst component is applied to the surface of a conductive cathode base having a plurality of intersection portions, such as a wire mesh, by an application method to form cathode catalyst layers on the front and rear sides of the conductive base, a solidified portion (extra and unnecessary portion) including an excessive amount of cathode catalyst component is not generated in the plurality of intersection portions due to a liquid pool of the application liquid. Even if the solidified portion is generated due to the liquid pool of the application liquid, the cross-sectional shape of the solidified portion has mesh-shaped pores in which a plurality of cavities can be observed. As a result, the extra and unnecessary solidified portion is reduced. Therefore, the amount of expensive cathode catalyst component used to form the cathode catalyst layer can be effectively reduced, as compared to the cathode catalyst layer according to the related art. As a result, it is possible to provide a cathode for electrolysis with economic efficiency.

(2) After the application liquid is applied to the base, the drying of the application liquid can be accelerated. Therefore, the contact time between the acid application liquid and the nickel base is short and it is possible to prevent the elution of nickel to the cathode catalyst layer. As a result, a nickel layer is not formed in the cathode catalyst layer. That is, when the application liquid is baked at a high temperature during the formation of the cathode catalyst layer, nickel is not precipitated as a nickel precipitate in the cathode catalyst layer and the peeling of the cathode catalyst layer due to a nickel precipitate is prevented. As a result, it is possible to reduce the amount of cathode catalyst consumed when the cathode for electrolysis is used and to improve the durability of the cathode for electrolysis.

When the temperature is greater than 120° C., a solvent of the application liquid, such as water, starts to be rapidly evaporated even though the temperature is significantly less than the boiling point of the application liquid. As a result, a phase change, such as bumping, occurs in the application liquid at a temperature less than the temperature at which a thermal decomposition reaction occurs and it is difficult to obtain a uniform catalyst layer due to pores formed in the cathode catalyst layer. For this reason, the temperature needs to be equal to or less than 120° C. As described above, the temperature is preferably equal to or less than 63° C. in terms of economic efficiency.

According to the examination results of the inventors, when the above-mentioned simple preheating step is performed, a liquid pool caused by the stagnation of an excessive amount of application liquid is not generated in the intersection portion of the metal wire of the wire mesh-like base. Even in a case in which the liquid pool is generated, when the application liquid applied to the wire mesh-like base is dried and baked to form a cathode catalyst layer, the cross-sectional shape of the "solidified portion of the liquid pool" has mesh-shaped pores which are solidified while having a plurality of cavities. The inventors consider the following mechanism. The temperature of a wire mesh-like base when a room-temperature (ambient-temperature) application liquid is applied is greater than room temperature (ambient temperature) and is in a specific temperature range defined in the invention. In this case, immediately after the application liquid is applied to the base, the application liquid is quickly dried. In the dry step after the application step, the evaporation of a solvent in the applied application liquid is accelerated and the spreading of the application liquid is prevented. The application liquid is rapidly solidified. As a result, a liquid pool is less likely to be generated in the intersection portion. Even if the liquid pool is generated, the cross-sectional shape of the "solidified portion of the liquid pool" has mesh-shaped pores having a plurality of cavities which can be observed, as illustrated in FIG. 2-1. Therefore, it is possible to reduce the amount of catalyst component used.

For example, when the preheating step is performed to heat the wire mesh-like base such that the temperature of the wire mesh-like base when a room-temperature (ambient-temperature) application liquid is applied is in the range of 43° C. to 120° C., preferably, in the range of 43° C. to 63° C. and a cathode catalyst layer is formed, average porosity in the cross section of the "solidified portion of the liquid pool" which may be generated in a plurality of intersection portions of the wire mesh-like base is equal to or greater than 15%, which will be described below. In addition, when the preheating step is performed to increase the temperature of the wire mesh-like base when the room-temperature (ambient-temperature) application liquid is applied to about 63° C., average porosity in the cross section of the "solidified portion of the liquid pool" generated in the intersection portions of the wire mesh-like base can be equal to or greater than 44%.

Preheating Means

For example, an induction heating device is preferably used as a means for heating the wire mesh-like base in the preheating step in terms of high heating efficiency and a high temperature rise response. Of course, other heating means may be used. In addition, a heating method that emits radiant heat using, for example, infrared rays or a radiant tube or a heating method that blows hot air to the conductive base may be used as other heating means. These methods can be appropriately used according to circumstances.

Induction heating (hereinafter, abbreviated to IH) is a method in which a current flows through a heating coil, using the principle of electromagnetic induction, to heat an electric conductor, such as metal, which is a heating target. The principle of heating is as follows. When an alternating current flows to the heating coil, magnetic field lines with variable strength are generated around the heating coil. When an electric conductor, such as metal, is placed in the vicinity of the heating coil, the metal is affected by the magnetic field lines with variable strength and an eddy current flows through the metal. Joule heat corresponding to $(\text{current})^2 \times \text{resistance}$ is generated by the electric resistance of the metal and the metal is self-heated. This phenomenon is referred to as induction heating IH. The biggest advantage of IH is that it is possible to heat a conductive base to a desired temperature in a few of seconds from the start of heating. Therefore, when IH is used, preheating and application facilities can be provided so as to be adjacent to each other.

2-2: Application Step

Next, the application step of applying the application liquid including the starting material of the cathode catalyst component defined in the manufacturing method according to the invention to at least one surface of the wire mesh-like base of which the temperature has been adjusted in the temperature range of 43° C. to 120° C. as described above will be described. A method for applying the application liquid at that time is not particularly limited. The application liquid may be applied to at least one surface of the wire mesh-like base in the above-mentioned temperature range by, for example, a method using a roller or a spray and may be dried and baked to form a catalyst layer. In this case, the above-mentioned remarkable effect of the invention is obtained. In addition to the method using a roller or a spray, for example, a brush application method, an electrostatic coating method, and other methods may be used as the application method.

A solution obtained by dissolving the starting material of the catalyst component in, for example, an inorganic solvent or an organic solvent is given as an example of the application liquid used in the above-mentioned step. Specifically, the application liquid is manufactured as follows. For example, an inorganic or organic compound of at least one metal of platinum, iridium, ruthenium, palladium, and osmium is used as the starting material of the cathode catalyst component used to manufacture an insoluble metal anode. For example, chloride, sulfate, and nitrate of the above-mentioned metal materials are given as examples of the starting material. A solution obtained by dissolving the starting material in a solvent can be used as the application liquid including the starting material. An inorganic solution or an organic solution obtained by adding a solution, which is obtained by dissolving an inorganic or organic compound of valve metal, such as titanium, tantalum, niobium, zirconium, or hafnium, in an inorganic solvent or an organic solvent, to the starting material of the catalyst component can be used as the application liquid used in the invention.

For example, in addition to the above-mentioned starting material, a nickel compound, a compound of rare earth elements, such as lanthanum, cerium, and yttrium, and a hydrate of an oxalic acid are preferably used as the starting material of the cathode catalyst component used to manufacture the cathode for electrolysis.

The following materials are given as examples of the compound used as the starting material of the cathode catalyst component. Of course, the compound is not limited to the following materials:

Platinum: chloroplatinic acid or platinum nitric acid compound:

Iridium: iridium chloride

Ruthenium: ruthenium chloride

Palladium: palladium chloride

Titanium: titanium chloride

Tantalum: tantalum pentachloride

Cerium: cerium chloride

Nickel: nickel nitride

An acidic solvent may be used as the application liquid used in the invention. Specifically, an inorganic acidic solvent, such as hydrochloric acid, sulfuric acid, or nitric acid, is given as an example. In addition, a mixed solution of the above-mentioned acidic solvent and an organic solvent, such as alcohol with high volatility, may be used as the solvent of the application liquid used in the invention. Specifically, for example, an inorganic solution obtained by dissolving iridium tetrachloride and tantalum pentachloride in 35% of hydrochloric acid is given as an example. Other examples of the application liquid may include acid application liquids, such as an inorganic or organic mixed solution obtained by dissolving a ruthenium chloride, iridium chloride, or titanium chloride solution in hydrochloric acid and isopropyl alcohol (IPA) and an inorganic solution obtained by dissolving diammine dinitro platinum and cerium nitride in nitric acid.

An example of the application conditions when the above-mentioned application liquid is applied to at least one surface of the wire mesh-like base having the above-mentioned structure in the invention will be described. Of course, the invention is not limited thereto. When an anode for brine electrolysis is manufactured, for example, the amount of application liquid applied by one application operation is 0.36 g to 0.66 g, the number of times the application liquid is applied is 6 to 12, and the total amount of application liquid applied is 2.16 g to 5.28 g, which depends on the concentration of the starting material of the catalyst component in the application liquid. In the invention, the important point is that, when an ambient-temperature (room-temperature) application liquid is applied under these conditions and the application is performed one or more times, the temperature of the wire mesh-like base immediately before the application is in the range of 43° C. to 120° C., preferably, in the range of 43° C. to 63° C. The other structures are not particularly limited. When the application is repeated as described above, it is preferable that the temperature of the wire mesh-like base immediately before the application be in the above-mentioned temperature range whenever the ambient-temperature (room-temperature) application liquid is applied. According to this structure, it is possible to improve average porosity in the cross section of the "solidified portion of the liquid pool" which may be generated in a plurality of intersection portions of the wire mesh-like base. As a result, it is possible to reduce the amount of expensive cathode catalyst component used to form the cathode catalyst layer and the cathode for electrolysis according to the invention is economical.

The examination results of the inventors proved that, during the manufacture of the cathode for electrolysis according to the invention, when a high-concentration solution was used as the application liquid including the starting material of the cathode catalyst component, porosity in the cross section of the "solidified portion of the liquid pool" tended to be improved. When the concentration of the application liquid increases, a remarkable effect is obtained by the invention. It is considered that the reason is as follows. An increase in the concentration of the application liquid means a reduction in the amount of solvent in the application liquid. The remarkable effect of the invention is obtained by the synergy between the increase in the concentration of the application liquid and the preheating step which heats the wire mesh-like base such that the temperature of the wire mesh-like base immediately before the application is in the range of 43° C. to 120° C. and the application liquid is quickly dried immediately after the application. An application performance varies depending on the type of starting material of the catalyst component or the type of solvent. However, the concentration of the cathode catalyst component in the application liquid used in the invention is preferably, for example, in the range of about 20 g/L to 500 g/L and more preferably in the range of about 50 g/L to 250 g/L.

2-3: Dry Step

The application layer formed in the application step is dried and baked to form a catalyst layer. The dry step is not particularly limited. For example, the application layer is leveled through a dry zone of a continuous furnace following a coating booth and is dried at a set temperature of 30° C. to 80° C. for a dry time of 5 minutes to 10 minutes. The dry step is performed after the application liquid is applied and before the baking step and is clearly distinguished from the preheating step of heating the wire mesh-like base before the application liquid is applied such that the temperature of the base to which the application liquid is applied is in a specific range, which characterizes the invention.

2-4: Baking Step

The application liquid layer after the dry step 2-3 is baked in the baking step and becomes a cathode catalyst layer including the catalyst component (a material forming the catalyst layer). When application, dry, and baking are repeated, the application liquid layer becomes a portion of the catalyst layer. A baking method in the baking step is not particularly limited. For example, the baking step is performed using a baking zone of a continuous furnace following a dry zone in which the dry step is performed. Baking conditions are not particularly limited. The baking conditions vary depending on the type of cathode catalyst component. For example, baking is performed under the conditions of an ambient atmosphere, a baking temperature of about 350° C. to 600° C., and a baking time of 10 minutes to 15 minutes.

When baking is performed under these conditions, the starting material in the application liquid is thermally decomposed. In the case of an anode, a catalyst layer including a cathode catalyst component made of at least one type of platinum-group metal selected from, for example, platinum, iridium, ruthenium, palladium, osmium, and oxides thereof and/or alloys thereof is formed. A catalyst layer including a composite oxide which is obtained by adding an oxide of valve metal, such as titanium, tantalum, niobium, zirconium, or hafnium, to the platinum-group metal and/or the oxide thereof or a cathode catalyst component which is made of a solid solution is formed, depending on a component of the starting material to be included in the application liquid. In the case of a cathode, a cathode catalyst layer including a composite oxide of the platinum-group metal, nickel, and/or an oxide thereof and an oxide of a rare earth element, such as cerium or lanthanum, is formed.

3. Post-Processing

In the method for manufacturing the cathode for electrolysis according to the invention, after the catalyst layer forming step is performed, post-processing including a performance adjustment step, a neutralization step, and a shaping step is performed, if necessary, as illustrated in FIG. 1. In this way, the cathode for electrolysis is manufactured. In the invention, the post-processing step may be performed by the same method as that in the related art and is not different from that in the method according to the related art.

As represented by a dashed line in FIG. 1, the application step 2-2 is performed again after the baking step 2-4 and before the post-processing step 3. Then, the dry and baking steps are repeated to form a cathode catalyst layer with a desired thickness. In this case, after baking, the temperature of the conductive base is rapidly naturally reduced since the base, which is a processing target in the invention, is, for example, a wire mesh-like base with a large surface area. According to the examination results of the inventors, when a series of steps is repeated in a general order, the temperature of the conductive base immediately before the application liquid is applied when the application liquid is applied again is reduced to ambient temperature and is not equal to or greater than at least 43° C. defined in the manufacturing method according to the invention.

Examples

Next, the invention will be described in detail with reference to Examples and Comparative Examples. However, the invention is not limited thereto.

Examples 1 to 4 and Comparative Examples 1 and 2

Formation of Cathode Catalyst Layer

According to the process diagram illustrated in FIG. 3, a conductive base which was a wire mesh was used and a catalyst layer including a cathode catalyst component was formed on the wire mesh-like base by an application method. As illustrated in FIG. 3, the wire mesh-like base which was preprocessed in the preprocessing step 1 was used as the conductive base and a cathode catalyst layer was formed on the wire mesh-like base by the cathode catalyst layer forming step 2. At that time, the preheating step 2-1 was not performed or the preheating step was performed to change the temperature of the wire mesh-like base immediately before the application liquid was applied to various values. The steps 2-2 to 2-4 were the same as those in the method which will be described below. Then, in order to compare the properties of intersection portions of the obtained wire mesh-like base having the cathode catalyst layer formed thereon, samples for measuring porosity in the cross section of a "solidified portion of a liquid pool" were manufactured by the procedure of step 4 illustrated in FIG. 3 and porosity was measured by a method which will be described below. Then, the effect of reducing the amount of expensive cathode catalyst component obtained by the preheating step characterizing the invention was evaluated using the measured porosity. Next, for example, the procedure of each step will be described.

Conductive Cathode Base

In the above-mentioned test, a plain-woven wire mesh base (ϕ0.15×40 meshes) made of nickel was used as the conductive base. Tests were performed under different conditions. In each test under each condition, four wire meshes with a size of 100 $mm^2$. The following preprocessing was performed for these wire mesh-like bases.

1. Preprocessing Step

1-1: Roughening Step

A dry blast process was performed on both surfaces of the wire mesh-like base using an alumina abrasive (#320 size) to roughen the surfaces.

1-2: Etching Step

The wire mesh-like base was immersed in 20% of hydrochloric acid aqueous solution (about 25° C.) for about 3 minutes to perform an etching process and a water cleaning process for the base at the same time.

1-3: Corrosion Resistance Improving Step

A heating process was performed for the wire mesh-like base in an ambient atmosphere at a temperature of about 500° C. within 30 minutes.

Application Liquid

A ruthenium chloride ($RuCl_3$) solution, cerium chloride powder, and oxalic acid powder were used as the starting material of the cathode catalyst component and an inorganic and organic mixed solution obtained by dissolving a mixture of cerium chloride powder and oxalic acid powder in a ruthenium chloride solution was prepared as an acid application liquid. At that time, two types of application liquids, that is, a low-concentration application liquid and a high-concentration application liquid in which a combination concentration was adjusted to a Ru concentration of 100 g/L and a Ru concentration of 200 g/L were produced.

2. Cathode Catalyst Layer Forming Step

A catalyst layer was formed on the wire mesh-like base, using the wire mesh-like base and the application liquid, according to the cathode catalyst layer forming step 2 illustrated in FIG. 3.

2-1: Preheating Step

An electric furnace with an internal size of 200 mm (W)×200 mm (H)×200 mm (L) was prepared and was used to heat samples before application.

Then, for the heating conditions of the wire mesh-like base to be heated, the temperature of the electric furnace was set such that the temperature of the wire mesh-like base immediately before the application liquid was applied was set to the following three types. Preheating was maintained for 5 minutes and the temperature of the wire mesh-like base was adjusted to a desired uniform temperature. Then, as described below, Examples and Comparative Examples were distinguished from each other on the basis of a difference in the temperature of the wire mesh-like base immediately before a room-temperature (ambient-temperature) application liquid was applied, from a difference in the cross-sectional shape of the "solidified portion of the liquid pool" in an intersection portion of the cathode catalyst layer formed on the wire mesh-like base, which will be described below.

(1) Heating is not Performed (an Ambient Temperature of 25° C., Comparative Examples 1 and 2)

(2) A heating temperature was set to 60° C. and preheating was performed to increase the temperature of the wire mesh-like base immediately before the application liquid was applied. Then, the temperature of each wire mesh-like base at that time was measured. The measurement results showed that the temperature of each base was stabilized in the range of 43° C. to 46° C. (Examples 1 and 2). Hereinafter, 43° C. is the lower limit at which the effect is verified by the above-mentioned test and this condition is represented by 43° C. In the specification, the representation of 43° C. has the same meaning as described above.

(3) A heating temperature was set to 90° C. and preheating was performed to increase the temperature of the wire mesh-like base immediately before the application liquid was applied. Then, the temperature of each wire mesh-like base at that time was measured. The measurement results showed that the temperature of each base was stabilized in the range of 62° C. to 64° C. (Examples 3 and 4). Hereinafter, this condition is represented by a median of 63° C. That is, 63° C. means the measured temperature with an error of ±1° C. In the specification, the representation of 63° C. has the same meaning as described above.

2-2: Application Step, 2-3: Dry Step, 2-4: Baking Step

The prepared low-concentration application liquid (an application liquid with a concentration of 100 g/L) and the prepared high-concentration application liquid (an application liquid with a concentration of 200 g/L) were applied to one surface of each wire mesh-like base that was adjusted to each temperature in the preheating step by roller coating in a coating booth immediately after the wire mesh-like base was taken out of the electric furnace. Next, the application step will be described in detail.

In the preheating step and the application step, the following were prepared and used in addition to the application liquid and the wire mesh-like base. A back plate (a Ti thin plate with a thickness of 3 mm) for holding the wire mesh-like base was used in order to prevent the temperature of the preheated wire mesh-like base from being rapidly reduced in the atmosphere in the coating booth in the step of applying the room-temperature (ambient-temperature) application liquid. In addition, an application roller for applying the application liquid and application table were prepared and application was performed as described below. A table that could be inserted into a Ti mesh dry and baking furnace was used as the application table.

Then, the procedure and point of the application step, the dry step, and the baking step were as follows.

In the application step, the application liquid was applied to each wire mesh-like base according to a combination of the type of application liquid and the temperature of the wire mesh-like base immediately before the application liquid was applied. Then, in the dry step and the baking step, the application liquid was dried and baked to form a cathode catalyst layer. At that time, specifically, the following were performed.

(a) An identification mark was stamped in each wire mesh-like base in advance. At that time, a variation was checked using four wire mesh-like bases under each condition.

(b) The application liquid was rapidly applied, using the back plate for holding the base such that the temperature of the wire mesh-like base was not changed.

(c) A prescribed amount of application liquid was poured into a container. An appropriate amount of application liquid was infiltrated into a roller. The roller was lightly pressed against the base to transfer the application liquid. In addition, the entire prescribed amount of application liquid was transferred and applied.

(d) After the application liquid was applied, the application liquid was dried at 60° C. for 5 minutes in the dry step.

(e) After the application liquid was dried, the application liquid was baked at 550° C. for 10 minutes in the baking step.

(f) The processes (c) to (e) were repeatedly performed for each wire mesh-like base a predetermined number of times (12 times) to form a cathode catalyst layer.

In addition, the "solidified portion of the liquid pool" in an intersection portion of the wire mesh-like base was observed, porosity in the cross section of the solidified portion was measured by a method, which will be described below, and the degree of reduction in the amount of cathode catalyst component was evaluated, which will be described below. As illustrated in Table 1, a clear difference in the shape of the "solidified portion of the liquid pool" of the formed catalyst layer was confirmed by a difference in the temperature of the wire mesh-like base immediately before the application liquid was applied and was caused by the difference in the temperature of the wire mesh-like base immediately before the application liquid was applied. Therefore, as illustrated in Table 1, these wire mesh-like bases were Examples 1 to 4 and Comparative Examples 1 and 2. In Table 1, the temperature of the wire mesh-like base immediately before the application liquid is applied, the amount of application liquid applied, and the number of times the application liquid is applied are illustrated. As illustrated in Table 1, six types of evaluation samples 1 to 6 were manufactured by a method, which will be described below, using the wire mesh-like bases according to Examples 1 to 4 and Comparative Examples 1 and 2 on which the cathode catalyst layers were formed. In Table 1, the temperature of a base means the temperature of the wire mesh-like base immediately before the application liquid is applied and the amount of application liquid applied is calculated from the concentration of the application liquid with a yield of 100%.

TABLE 1

Conditions of Examples 1 to 4, and Comparative Examples 1 and 2

| | Temperature of base | | | | |
|---|---|---|---|---|---|
| Application liquid | 25° C. | 43° C. | 63° C. | Amount of application | Number of times of application |
| Application liquid with a | Sample 1 (Com- | Sample 3 (Example | Sample 5 (Example | 0.46 ml/time | 12 times |

TABLE 1-continued

Conditions of Examples 1 to 4, and Comparative Examples 1 and 2

| Application liquid | Temperature of base 25° C. | 43° C. | 63° C. | Amount of application | Number of times of application |
|---|---|---|---|---|---|
| concentration of 100 g/L | parative Example 1) | 1) | 3) | | |
| Application liquid with a concentration of 200 g/L | Sample 2 (Comparative Example 2) | Sample 4 (Example 2) | Sample 6 (Example 4) | 0.23 ml/time | 12 times |

For the samples according to Examples 1 to 4 (samples 3 to 6) and Comparative Examples 1 and 2 (samples 1 and 2) illustrated in Table 1, measurement samples were manufactured by a process in the step 4 of manufacturing a sample for measuring porosity illustrated in FIG. 3 in order to observe the cross-sectional shape of the "solidified portion of the liquid pool" in an intersection portion of the wire mesh-like base and to measure porosity. Then, porosity in the cross section of the "solidified portion of the liquid pool" was measured by a method, which will be described below, using the manufactured samples.

4: Method for Measuring Porosity in Cross Section of "Solidified Portion of Liquid Pool"

(4-1) Acquisition of Measurement Sample

A portion with a size of about 20 $mm^2$ was cut out from a central portion of each of the wire mesh-like bases according to Examples 1 to 4 and Comparative examples 1 and 2 on which the catalyst layers in the manufactured samples 1 to 6 were formed.

(4-2) Embedding of Wire Mesh-like Base into Resin and Polishing of Wire Mesh-like Base The cutout of the wire mesh-like base was embedded into a transparent resin in the vertical direction and the wire mesh-like base was ground to manufacture a measurement sample in which the cross section of the base in the intersection portion was exposed.

(4-3) Observation with Electron Microscope

The cross section of the "solidified portion of the liquid pool" in the intersection portion was observed by an electron microscope and an image used to measure porosity was extracted.

(4-4) Measurement of Porosity

For each "solidified portion of the liquid pool" in the image observed and extracted by the electron microscope, porosity was measured by image software for a binarization process. The measured porosities were illustrated in FIGS. 4-1 to FIG. 6-2. Specifically, as illustrated in FIGS. 4-1 and 4-2, first, for the cross-sectional shape of the "solidified portion of the liquid pool" in the extracted image, an operation of specifying the range of the solidified portion caused by a liquid pool such that the solidified portion was recognized was performed and the area of the solidified portion was calculated. In addition, an operation of specifying a plurality of hole portions in the specified range such that the hole portions were recognized and the area of each hole was calculated. Then, the total area of the holes was calculated. Then, the ratio of the total area of the holes to the area of the solidified portion caused by the liquid pool was calculated and was used as porosity in the cross section of the "solidified portion of the liquid pool".

FIGS. 4-1 and 4-2 illustrate the measurement state of four samples 5 in which the temperature of the wire mesh-like base immediately before 100 g/L of low-concentration application liquid is applied is 63° C. in Example 3. As illustrated in FIGS. 4-1 and 4-2, porosity was measured in the "solidified portions of the liquid pools" disposed on both sides of a member in the image of the cross section of an intersection portion between the members forming the wire mesh in each of four wire mesh-like bases. Therefore, the number of measured values of porosity is eight for each condition. FIG. 5 illustrates the measurement state of porosity when the temperature of the wire mesh-like base immediately before 200 g/L of high-concentration application liquid is applied is 63° C. in Example 4 (sample 6) and also illustrates an example of a portion of the measurement result for comparison with Example 3 (sample 5). The comparison between two samples shows that porosity in Example 4 (sample 6) using the high-concentration application liquid is higher than that in Example 3 (sample 5) in which the low-concentration application liquid is applied. As can be seen from FIG. 5, in some cases, the "solidified portion of the liquid pool" was not generated under the conditions of Example 4 (sample 6).

FIGS. 6-1 and 6-2 illustrate the measurement state of porosity in the cross section of the "solidified portion of the liquid pool" in the intersection portion in Comparative Example 1 (sample 1) in which preheating is not performed and 100 g/L of low-concentration application liquid is applied to the wire mesh-like base at ambient temperature. The intersection portion illustrated in FIGS. 6-1 and 6-2 is clearly different from the cross-sectional shape of the "solidified portion of the liquid pool" illustrated in FIGS. 4-1 and 4-2 and FIG. 5 and does not have mesh-shaped pores in which a plurality of cavities can be observed as in Examples of the invention. Therefore, it was confirmed that porosity was clearly less than that in Examples of the invention.

The obtained measurement results of porosity in the cross section of the "solidified portion of the liquid pool" in the intersection portion of the wire mesh-like base in each of Comparative Examples 1 and 2 (samples 1 and 2) and Examples 1 to 4 (samples 3 to 6) are collectively illustrated in Table 2 and Table 3. Table 2 illustrates the measurement results when 100 g/L of low-concentration application liquid is used and Table 3 illustrates the measurement results when 200 g/L of high-concentration application liquid is used.

TABLE 2

Comparing result of porosities caused by differences in temperature of the bases in the case of applying the application liquid with low concentration

| Comparative Examples/Examples | FIG. | Sample No. | Temperature of base (° C.) | Porosity (%) |
|---|---|---|---|---|
| Comparative Example 1-1 (left side) | FIG. 6-1(1) | Sample 1 | 25 (Room temperature) | 6.0 |
| (right side) | | | | 3.1 |
| Comparative Example 1-2 (left side) | FIG. 6-1(2) | Sample 1 | 25 (Room temperature) | 10.3 |

TABLE 2-continued

Comparing result of porosities caused by differences in temperature of the bases in the case of applying the application liquid with low concentration

| Comparative Examples/Examples | FIG. | Sample No. | Temperature of base (° C.) | Porosity (%) |
|---|---|---|---|---|
| (right side) | | | | 11.3 |
| Comparative Example 1-3 (left side) | FIG. 6-2(3) | Sample 1 | 25 (Room temperature) | 10.8 |
| (right side) | | | | 0.8 |
| Comparative Example 1-4 (left side) | FIG. 6-2(4) | Sample 1 | 25 (Room temperature) | 12.1 |
| (right side) | | | | 6.3 |
| | | | Arithmetic mean | 7.6 |
| Example 1-1 (left side) | Not shown | Sample 3 | 43 | 8.6 |
| (right side) | | | | 19.5 |
| Example 1-2 (left side) | | Sample 3 | 43 | 23.7 |
| (right side) | | | | 15.7 |
| Example 1-3 (left side) | | Sample 3 | 43 | 8.5 |
| (right side) | | | | 11.1 |
| Example 1-4 (left side) | | Sample 3 | 43 | 18.6 |
| (right side) | | | | 13.1 |
| | | | Arithmetic mean | 17.3 |
| Example 3-1 (left side) | FIG. 4-1(1) | Sample 5 | 63 | 36.8 |
| (right side) | | | | 25.8 |
| Example 3-2 (left side) | FIG. 4-1(2) | Sample 5 | 63 | 42.3 |
| (right side) | | | | 38.0 |
| Example 3-3 (left side) | FIG. 4-2(3) | Sample 5 | 63 | 51.3 |
| (right side) | | | | 66.8 |
| Example 3-4 (left side) | FIG. 4-3(4) | Sample 5 | 63 | 38.7 |
| (right side) | | | | 48.4 |
| | | | Arithmetic mean | 43.5 |

FIG. 7 illustrates the measurement results of porosity when the low-concentration application liquid illustrated in Table 2 is used. In FIG. 7, data of eight porosities which are measured under each condition by the above-mentioned method is plotted with respect to the temperature of the wire mesh-like base immediately before the application liquid is applied. In FIG. 7, a straight line indicates values obtained by performing a statistical process using the measured values and there is a high correlation between the values. As illustrated in FIG. 7, a linear function represented by the following Expression (1) is calculated as an approximate expression by the statistical process:

$$y=0.9369x-19.495 \quad (1)$$

$R^2=0.7127.$

This shows that the temperature of the wire mesh-like base immediately before a room-temperature (ambient-temperature) application liquid is applied is increased to reliably increase porosity in the cross section of the "solidified portion of the liquid pool" in the intersection portion of the wire mesh-like base. An increase in porosity in the cross section of the "solidified portion of the liquid pool" means a reduction in the amount of expensive cathode catalyst component used to form the catalyst layer.

TABLE 3

Comparing result of porosities caused by differences in temperature of the bases in the case of applying the application liquid with high concentration

| Comparative Examples/Examples | FIG. | Sample No. | Temperature of base (° C.) | Porosity (%) |
|---|---|---|---|---|
| Comparative Example 2-1 (left side) | Not shown | Sample 2 | 25 (Room temperature) | 18.2 |
| (right side) | | | | 7.1 |
| Comparative Example 2-2 (left side) | | Sample 2 | 25 (Room temperature) | 4.6 |
| (right side) | | | | 4.2 |
| Comparative Example 2-3 (left side) | | Sample 2 | 25 (Room temperature) | 5.7 |
| (right side) | | | | 6.0 |
| Comparative Example 2-4 (left side) | | Sample 2 | 25 (Room temperature) | 4.7 |
| (right side) | | | | 11.0 |
| | | | Arithmetic mean | 7.7 |
| Example 2-1 (left side) | Not shown | Sample 4 | 43 | 17.5 |
| (right side) | | | | 28.7 |
| Example 2-2 (left side) | | Sample 4 | 43 | 11.0 |
| (right side) | | | | 10.6 |
| Example 2-3 (left side) | | Sample 4 | 43 | 17.2 |
| (right side) | | | | 19.3 |
| Example 2-4 (left side) | | Sample 4 | 43 | 15.7 |
| (right side) | | | | 18.1 |
| | | | Arithmetic mean | 17.3 |
| Example 4-1 (left side) | Not shown | Sample 6 | 63 | 45.6 |
| (right side) | | | | 38.8 |
| Example 4-2 (left side) | FIG. 5 (1) | Sample 6 | 63 | 40.6 |
| (right side) | | | | 46.5 |
| Example 4-3 (left side) | Not shown | Sample 6 | 63 | 23.5 |
| (right side) | | | | 42.3 |
| Example 4-4 (left side) | FIG. 5 (2) | Sample 6 | 63 | 100.0 |
| (right side) | | | | 100.0 |
| | | | Arithmetic mean | 54.7 |

FIG. 8 illustrates the measurement results of porosity when the high-concentration application liquid illustrated in Table 3 is used. In FIG. 8, data of eight porosities which are measured under each condition by the above-mentioned method is plotted with respect to the temperature of the wire mesh-like base immediately before the room-temperature (ambient-temperature) application liquid is applied. In FIG. 8, a straight line indicates values obtained by performing a statistical process using the measured values and there is a high correlation between the values, similarly to FIG. 7. As illustrated in FIG. 8, a linear function represented by the following Expression (2) is calculated as an approximate expression by the statistical process:

$$y=1.2261x-27.692 \quad (2)$$

$R^2=0.5409$

The comparison with FIG. 7 shows that, when the temperature of the wire mesh-like base immediately before the high-concentration application liquid is applied is increased as illustrated in FIG. 8, it is possible to stably and reliably increase porosity in the cross section of the "solidified portion of the liquid pool" in the intersection portion of the wire mesh-like base.

Table 4 collectively illustrates the measurement results illustrated in Tables 2 and 3 in samples 1 to 6 according to Examples and Comparative Examples in which the concentration of the application liquid and the temperature of the wire mesh-like base immediately before the application liquid is applied are changed, in terms of the width (variation) and maximum value of the measured value of porosity and average porosity for each condition. As can be seen from Table 4, the effect of improving porosity is improved by increasing the temperature of the wire mesh-like base immediately before the application liquid is applied and porosity is increased by increasing the concentration of the application liquid.

TABLE 4

Tendency of porosities in the cross section of the "solidified portion of the liquid pool"

| Temperature of base (° C.) | | Porosity in the cross section of the "solidified portion of the liquid pool" (%) | | | |
|---|---|---|---|---|---|
| | | | Application liquid with concentration of 100 g/l | | Application liquid with concentration of 200 g/l |
| 25 (Temperature of atmosphere) | Width of measured value | Comparative Example 1 (Sample 1) | 0.8-12.1 | Comparative Example 2 (Sample 2) | 4.2-18.2 |
| | Maximum | | 12.1 | | 18.2 |
| | Arithmetic mean | | 7.6 | | 7.7 |
| 43 | Width of measured value | Example 1 (Sample 3) | 8.5-23.7 | Example 2 (Sample 4) | 11.0-28.7 |
| | Maximum | | 23.7 | | 28.7 |
| | Arithmetic mean | | 14.9 | | 17.3 |
| 63 | Width of measured value | Example 3 (Sample 5) | 25.8-66.8 | Example 4 (Sample 6) | 23.5-100 |
| | Maximum | | 66.8 | | 100 (No solidified portion of the liquid pool) |
| | Arithmetic mean | | 43.5 | | 54.7 |

The following were confirmed from the above-mentioned results.

(1) Results of Comparative Example 1 and Comparative Example 2

When preheating characterizing the invention was not performed at all and the application liquid was applied with the wire mesh-like base being maintained at ambient temperature (25° C.), as can be seen from FIGS. 6-1 and 6-2 illustrating the results of sample 1 according to Comparative Example 1, the cross-sectional shape of the "solidified portion of the liquid pool" in the intersection portion of the wire mesh-like base was clearly different from that in Examples and did not have mesh-shaped pores in which cavities could be observed. This was the same in sample 2 according to Comparative Example 2 in which the concentration of the application liquid used was increased, which is not illustrated in the drawings. As can be seen from Tables 2 to 4, porosity in sample 1 according to Comparative Example 1 and sample 2 according to Comparative Example 2 had a maximum value of about 18% and a small average value of less than 8%, regardless of the concentration of the application liquid. When the application liquid was applied with the wire mesh-like base being maintained at ambient temperature (25° C.), an excessive amount of catalyst component was stagnated in the "solidified portion of the liquid pool" and the cathode catalyst component was unnecessarily used in a portion that did not contribute to improving the performance of the cathode.

(2) Results of Example 1 and Example 2—Base Temperature of 43° C.

In sample 3 according to Example 1 and sample 4 according to Example 2, the wire mesh-like base was heated in the electric furnace set to a temperature of 60° C. such that the temperature of the wire mesh-like base immediately before the room-temperature (ambient-temperature) application liquid was applied was about 43° C. and a catalyst layer was formed. Although not illustrated in the drawings, in these Examples, unlike Comparative Example illustrated in FIGS. 6-1 and 6-2, the cross-sectional shape of the "solidified portion of the liquid pool" in the intersection portion of the wire mesh-like base had mesh-shaped pores in which cavities could be observed. As can be seen from Tables 2 to 4 and FIG. 7, in sample 3 according to Example 1 and sample 4 according to Example 2, porosity in the cross section of the "solidified portion of the liquid pool" in the intersection portion of the wire mesh-like base had a maximum value of about 29% and an average value of 15% to 17% and was clearly greater than that in Comparative Examples in which the application liquid was applied with the wire mesh-like base being maintained at ambient temperature. This proves that, when the wire mesh-like base is heated to a high temperature of about 43° C. immediately before the application liquid is applied, the state in which an excessive amount of cathode catalyst component is unnecessarily used in the "solidified portion of the liquid pool" is reliably removed and it is possible to reduce the amount of cathode catalyst component used to form the catalyst layer.

(3) Results of Example 3 and Example 4—Base Temperature of 63° C.

In sample 5 according to Example 3 and sample 6 according to Example 4, the wire mesh-like base was heated in the electric furnace set to a temperature of 90° C. such that the temperature of the wire mesh-like base immediately before the room-temperature (ambient-temperature) application liquid was applied was about 63° C. and a catalyst layer was formed. As can be seen from FIGS. 4-1 and 4-2, in sample 5 according to Example 3, unlike Comparative Example illustrated in FIGS. 6-1 and 6-2, the cross-sectional shape of the "solidified portion of the liquid pool" in the intersection portion of the wire mesh-like base had mesh-shaped pores in which cavities could be observed. As can be seen from FIG. 5, in sample 6 according to Example 4 in which the concentration of the application liquid was higher than that in Example 3, it was possible to remove the "solidified portion of the liquid pool" in the intersection portion of the wire mesh-like base, according to circumstances. As can be seen from Tables 2 to 4 and FIG. 8, in sample 5 according to Example 3 and sample 6 according to Example 4 in which the temperature of the base is 63° C., porosity in the cross section of the "solidified portion of the liquid pool" in the intersection portion of the wire mesh-like base had a maximum value of 100% and an average value of 43% to 55% and had a large value of about 67% even when a solidified portion was present. This proves that, when the base is heated to a high temperature of 63° C., porosity is clearly greater than that in Comparative Examples in which the application liquid is applied with the wire mesh-like base being maintained at ambient temperature and sample 3 according to Example 1 and sample 4 according to Example 2 in which the temperature of the wire mesh-like base immediately before the application liquid is applied is about 43° C. and the amount of cathode catalyst component used is significantly reduced.

The comparison between sample 3 according to Example 1 and sample 4 according to Example 2 and the comparison between sample 5 according to Example 3 and sample 6 according to Example 4 show that, when 200 g/L of high-concentration application liquid is used as the application liquid, porosity in the cross section of the "solidified portion of the liquid pool" in the intersection portion of the wire mesh-like base tends to be greater than that when 100 g/L of low-concentration application liquid is used as the application liquid, regardless of the temperature of the wire mesh-like base immediately before the application liquid is applied, as illustrated in Table 4. It is considered that the reason is that, when the concentration of the application liquid is high, the amount of solvent in the application liquid is small and the synergy between the high-concentration application liquid and an increase in the temperature of the wire mesh-like base is created.

Examples 5 and 6 and Comparative Example 3

An electrolysis test was performed using cathodes for electrolysis according to Examples 5 and 6 in which cathode catalyst layers including a cathode catalyst component were formed on the front and rear sides of the conductive base by an application method that heated a wire mesh-like base such that the temperature of the wire mesh-like base immediately before an application liquid was applied was 43° C. (Example 5) and 63° C. (Example 6) in the preheating step before the application step, applied the application liquid to the base, and dried and baked the application liquid and a cathode for electrolysis according to Comparative Example 3 in which a cathode catalyst layer was formed by an application method that did not perform the preheating step, applied the application liquid to the wire mesh-like base at room temperature, and dried and baked the application liquid, similarly to Examples 5 and 6. Then, for electrodes before and after electrolysis, a nickel precipitate in the cathode catalyst layer and the peeling of the cathode catalyst layer due to the nickel precipitate were checked by the following experiments.

Evaluation

Test Sample Manufacturing Method

In a method for manufacturing samples according to Examples provided to the test, a series of application steps of heating a base at a predetermined temperature in an electric heating and dry furnace before an application liquid was applied, taking the base out of the dry furnace immediately before the application liquid was applied, applying the application liquid before the base was cooled, and drying and baking the application liquid was repeatedly performed a predetermined number of times to form test samples. Samples according to Comparative Examples were manufactured by the same method as described above except that the base was not heated and held.

When the samples according to Examples were manufactured, the temperature of the base immediately before the application liquid was applied was measured in advance and the measured temperature was defined as the temperature of the base immediately before application. In addition, the initial weight of the sample was measured before an evaluation test such that the amount of catalyst layer consumed by the evaluation test could be calculated.

Test Conditions

Electrolysis including reverse electrolysis was performed for each of the obtained electrode samples for evaluation in the order illustrated in Table 5. During reverse electrolysis, when a "nickel layer" is precipitated in the catalyst layer, the catalyst layer peels off. After the electrolysis test, the samples were washed with water, were dried, and were weighted. Then, the amount of catalyst layer consumed was calculated using the measured initial weight.

1) Evaluation Sample

Base: a plain-woven wire mesh using a nickel wire with a diameter (ϕ) of 0.15 mm Application liquid: the same application liquid as those in Examples 1 to 4

2) Electrolysis Conditions (in the Order of Electrolysis Illustrated in Table 5)

TABLE 5

Electrolysis conditions used in test

| Order | Current density | Condition of electrolyte |
|---|---|---|
| 1 | 80 A/dm$^2$ | 32 wt. % of NaOH |
| 2 | Stop | 60° C. |
| 3 | Reverse electrolysis 0.5 A/dm$^2$ | |
| 4 | Stop | |
| 5 | 80 A/dm$^2$ | |
| 6 | Stop | |

Test Results

The temperature of the base and the amount of catalyst layer consumed are illustrated in Table 6.

TABLE 6

Evaluating results

| | | Comparative Example 3 | Example 5 | Example 6 |
|---|---|---|---|---|
| Temperature of base just before application | | Room temperature (No heating of the base) | 43° C. | 63° C. |
| Amount of catalyst layer consumed by the evaluation test (mg/cm$^2$) | N = 2 | 0.704 | 0.327 | 0.187 |
| | | 0.708 | 0.348 | 0.201 |
| | Average | 0.706 | 0.338 | 0.194 |

As can be seen from the results illustrated in Table 6, the comparison between Examples 5 and 6 and Comparative example 3 shows that, when preheating is performed, the amount of catalyst layer consumed can be significantly less than that in Comparative example 3. The reason is as follows. When the base is heated, the drying of the application liquid is accelerated after the application liquid is applied. As a result, it is possible to prevent the elution of nickel from the conductive base into the cathode catalyst layer. In contrast, in the case of the electrode according to Comparative Example 3 in which the wire mesh-like base was not heated immediately before the application liquid was applied and was maintained at room temperature, the amount of catalyst layer consumed was 0.706 mg/cm$^2$ and was significantly more than that in Examples 5 and 6.

FIG. 9-1 is a diagram illustrating an SEM image of the cross section of the cathode for electrolysis according to Example 5 before the electrolysis test. Nickel in the cathode base is not eluted into the cathode catalyst layer and the cathode catalyst layer is made of only a catalyst component or an oxide thereof and is maintained in a stable state. Electrolysis and reverse electrolysis were performed using the cathode for electrolysis under the conditions illustrated in Table 5 and it was confirmed that the peeling of the cathode catalyst layer did not occur. It was confirmed that this was because the amount of catalyst layer consumed was small.

FIG. 9-2 is a diagram illustrating an SEM image of the cross section of an electrode of the cathode for electrolysis according to Comparative Example 3 before the electrolysis test. It was confirmed that nickel in the cathode base was eluted into the cathode catalyst layer and a layer was formed.

FIG. 9-3 is a cross-sectional view illustrating the electrode of Comparative Example 3 after electrolysis and reverse electrolysis illustrated in Table 5 are performed. Nickel in the cathode base is precipitated in the cathode catalyst layer and a nickel layer is eluted by electrolysis and reverse electrolysis. Therefore, voids are generated in the cathode catalyst layer and the cathode catalyst layer peels off from the voids.

INDUSTRIAL APPLICABILITY

According to the invention, when an application liquid including a cathode catalyst component is applied to a surface of a wire mesh-like base by an application method to form cathode catalyst layers including the cathode catalyst component on the front and rear sides of a conductive cathode base, it is possible to reduce the amount of expensive cathode catalyst component, such as precious metal, used to form a cathode catalyst layer, using a simple means that heats the wire mesh-like base such that the temperature of the wire mesh-like base immediately before a room-temperature (ambient-temperature) application liquid is applied is in a predetermined temperature range, without damaging the performance of a cathode. As a result, it is possible to obtain an economical cathode for electrolysis, without damaging the function of the cathode. In addition, in the economical cathode for electrolysis according to the invention, the peeling of the cathode catalyst layer caused by long-term electrolysis is prevented and the amount of cathode catalyst layer consumed is small. Therefore, the cathode for electrolysis has a higher durability than the electrode according to the related art. As described above, in the cathode for electrolysis and the method for manufacturing the cathode for electrolysis according to the invention, it is possible to reduce the amount of expensive cathode catalyst component used to form the cathode catalyst layer, using a simple method, without reducing the performance of the cathode, and the effect of preventing the peeling of the catalyst layer is obtained. In addition, the durability of the cathode is expected to be improved. In particularly, this is a technique that reduces the cost of raw materials and improves the economic efficiency of a product, which is a goal to be achieved in the electrode field. Therefore, the invention is expected to be used in a wide range.

The invention claimed is:

1. A cathode for electrolysis comprising:

a conductive cathode base that is a wire mesh, an expanded metal, or a perforated metal, wherein the wire mesh has a plurality of intersection portions between linear or strip-shaped members, and the expanded metal and the perforated metal have right-angled or acute portions of holes as a plurality of intersection portions; and a cathode catalyst layer that comprises a cathode catalyst component and is formed by applying an application liquid comprising a starting material of the cathode catalyst component to at least one surface of the conductive cathode base that has been pre-heated so as to have a temperature in a range from 43° C. to 63° C. immediately before the applying of the application liquid, and drying and baking the applied application liquid, wherein the cathode catalyst component comprises at least one material selected from the group consisting of platinum, iridium, ruthenium, palladium, osmium, nickel, and oxides thereof, the conductive cathode base is made of nickel or nickel alloy, the cathode has mesh-shaped pores having average porosity in a range from 15% to 100% in a cross-section view relative to average porosity of mesh-shaped pores of the conductive cathode base, where no solidified portion made of the dried and baked application liquid is formed at the intersection portions of the conductive cathode base when the average porosity of the mesh-shaped pores of the cathode is 100%, the application liquid is an acid, and in the cathode, formation of a nickel layer made of the nickel or nickel derived from the nickel alloy, which is eluted from the conductive cathode base, is suppressed.

2. The cathode for electrolysis according to claim 1, wherein the average porosity of the mesh-shaped pores of the cathode is in a range from 44% to 100%.

3. A method for manufacturing the cathode for electrolysis according to claim 1, comprising:

forming the cathode catalyst layer comprising the cathode catalyst component, by at least:

applying the application liquid being an acid and comprising a starting material of the cathode catalyst component to at least one surface of the conductive cathode base that is the wire mesh, the expanded metal, or the perforated metal, wherein the wire mesh has the plurality of intersection portions between linear or strip-shaped members, and the expanded metal and the perforated metal have right-angled or acute portions of holes as a plurality of intersection portions; and thereafter drying and baking the application liquid applied to the conductive cathode base, wherein the applying, the drying, and the baking are performed one time or a plurality of times, wherein the cathode catalyst component comprises the at least one material selected from the group consisting of platinum, iridium, ruthenium, palladium, osmium, nickel, and oxides thereof, the conductive cathode base is made of nickel or nickel alloy, in the forming of the cathode catalyst layer, the conductive cathode base is preheated such that the temperature of the conductive cathode base immediately before the applying the application liquid one or more times is in the range from 43° C. to 63° C.

4. The method for manufacturing the cathode for electrolysis according to claim 3, wherein, in the forming of the cathode catalyst layer, the conductive cathode base is preheated at an upstream side relative to a site of the applying the application liquid, in the applying of the application liquid, the drying and baking of the applied application liquid is repeated a plurality of times, and whenever the applying, the drying, and the baking of the application liquid are repeated, the conductive cathode base is pre-heated to the temperature in the range from 43° C. to 63° C. immediately before the applying the application liquid.

5. The cathode for electrolysis according to claim 1, wherein the conductive cathode base has been subjected to a corrosion resistance improving treatment before being pre-heated.

6. The method for manufacturing the cathode for electrolysis according to claim 3, wherein the conductive cathode base is subjected to a corrosion resistance improving treatment before the pre-heating of the conductive cathode base.

7. The method for manufacturing the cathode for electrolysis according to claim 6, wherein the corrosion resistance improving treatment of the conductive cathode base is conducted by heating the conductive cathode base in an ambient atmosphere at a temperature of about 500° C. for a time in a range of 30 minutes or less.

8. The method for manufacturing the cathode for electrolysis according to claim 3, wherein the application liquid is applied to the at least one surface of the conductive cathode base by at least one method selected from the group consisting of coating with a roller, spraying, coating with a brush, and an electronic coating.

9. The cathode for electrolysis according to claim 1, wherein the cathode catalyst layer is formed directly on the surface of the conductive cathode base made of the nickel or the nickel alloy.

10. The method for manufacturing the cathode for electrolysis according to claim 3, wherein the application liquid is applied directly to the at least one surface of the conductive cathode base made of the nickel or the nickel alloy.

* * * * *